US005752137A

United States Patent [19]

Haneda

[11] Patent Number: 5,752,137

[45] Date of Patent: May 12, 1998

[54] MULTI-COLOR IMAGE FORMING APPARATUS HAVING A PLURALITY OF DETACHABLE UNITS

[75] Inventor: Satoshi Haneda, Hachioji, Japan

[73] Assignee: Konica Corporation, Tokyo, Japan

[21] Appl. No.: 657,309

[22] Filed: Jun. 3, 1996

[30] Foreign Application Priority Data

| | | | |
|---|---|---|---|
| Jun. 9, 1995 | [JP] | Japan | 7-143053 |
| Jun. 12, 1995 | [JP] | Japan | 7-144502 |
| Jun. 14, 1995 | [JP] | Japan | 7-147735 |

[51] Int. Cl.[6] ..... G03G 15/01; G03G 15/00

[52] U.S. Cl. ..... 399/223; 399/112; 399/113; 399/218

[58] Field of Search ..... 355/215, 326 R, 355/327, 212, 200, 245, 210, 71; 347/115–118; 399/99, 162, 112, 178, 218, 113, 223

[56] References Cited

U.S. PATENT DOCUMENTS

| | | | |
|---|---|---|---|
| 4,277,160 | 7/1981 | Yamada | 347/122 |
| 5,053,821 | 10/1991 | Kunugi et al. | 355/245 |
| 5,444,515 | 8/1995 | Haneda et al. | 355/200 |
| 5,502,557 | 3/1996 | Choi et al. | 355/326 R |
| 5,537,199 | 7/1996 | Takai et al. | 355/326 R |
| 5,541,722 | 7/1996 | Ikeda et al. | 355/326 R |
| 5,552,863 | 9/1996 | Genovese | 355/210 |
| 5,557,377 | 9/1996 | Loewen et al. | 355/326 R |
| 5,585,893 | 12/1996 | Fujita et al. | 399/159 |

FOREIGN PATENT DOCUMENTS

| | | |
|---|---|---|
| 4-93856 | 3/1992 | Japan . |
| 5-307307 | 11/1993 | Japan . |

*Primary Examiner*—Arthur T. Grimley
*Assistant Examiner*—Quana Grainger
*Attorney, Agent, or Firm*—Frishauf, Holtz, Goodman, Langer & Chick

[57] ABSTRACT

A multi-color image forming apparatus includes a rotatable endless image forming member, plural exposure devices provided inside of the image forming member, and plural units each including a charger to electrically charge an outer surface of the image forming member and a developing device containing a color toner of plural different color toners to develop a latent image. Each of the plural units are disposed on the outer surface of the image forming member so as to be opposite to one of plural exposure devices so that multi-color toner images can be formed on the outer surface of the image forming member during a single rotation of the image forming member. in addition, each of the plural units is detachable from the apparatus independently of other units.

17 Claims, 19 Drawing Sheets

FIG. 8 ( A )
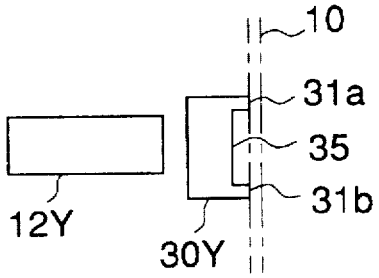
FIG. 8 ( B )
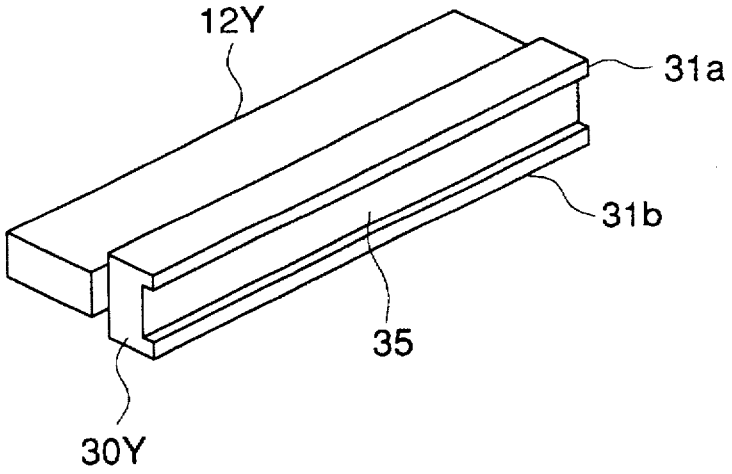

FIG. 9 ( A )
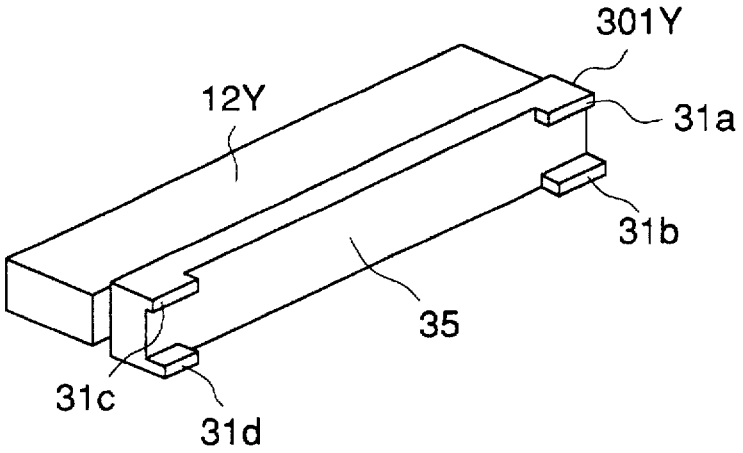
FIG. 9 ( B )
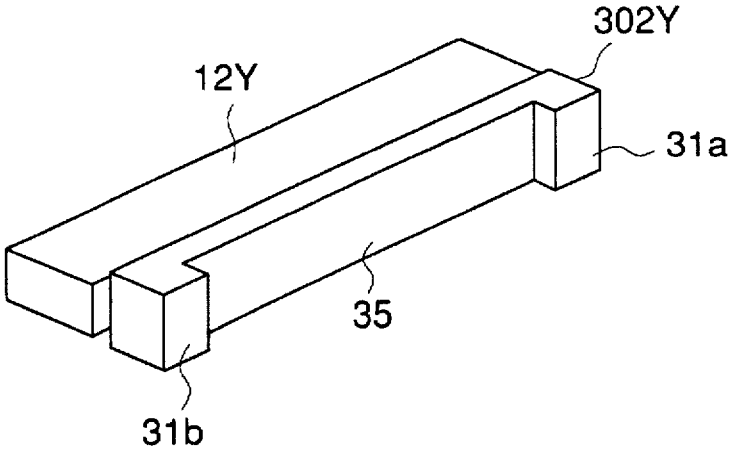

FIG. 10 ( A )
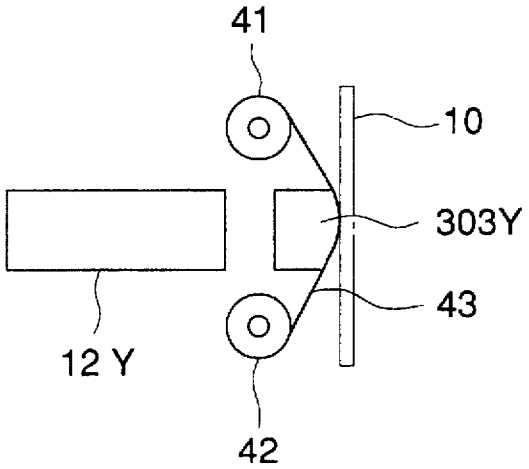
FIG. 10 ( B )
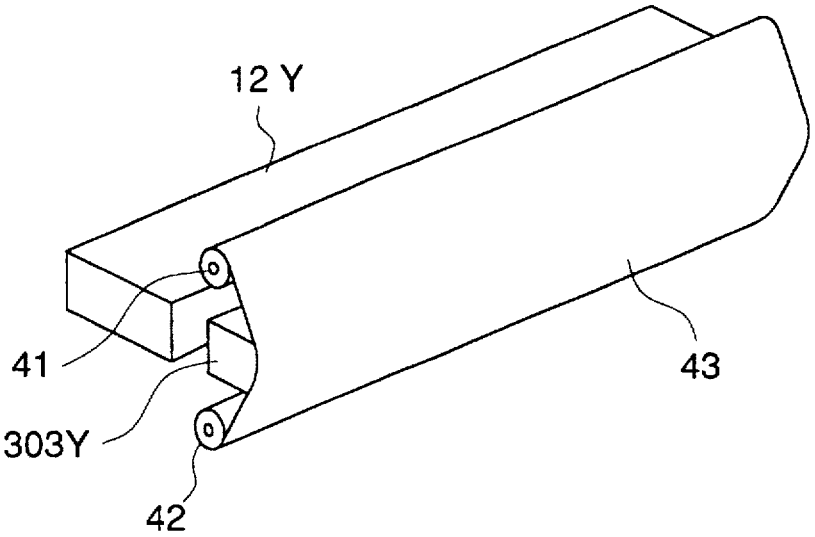

FIG. 20 ( A )
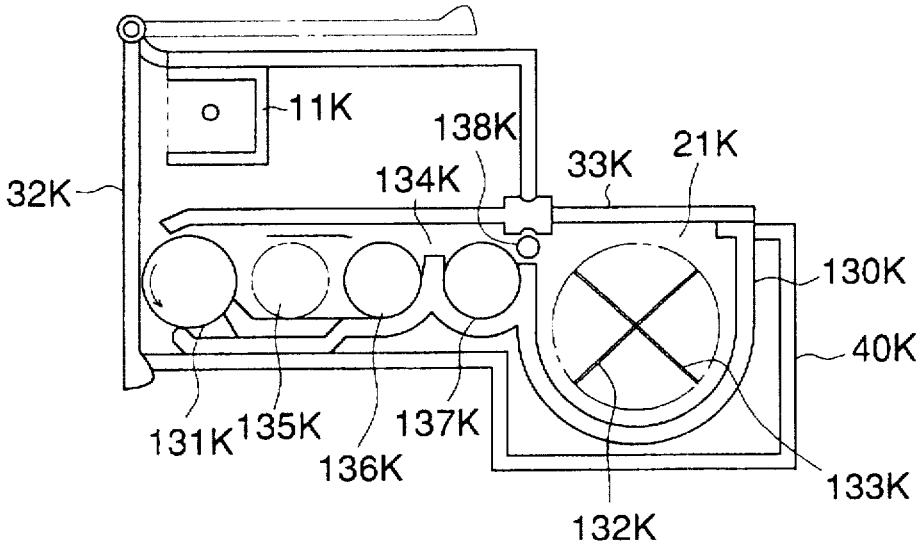
FIG. 20 ( B )
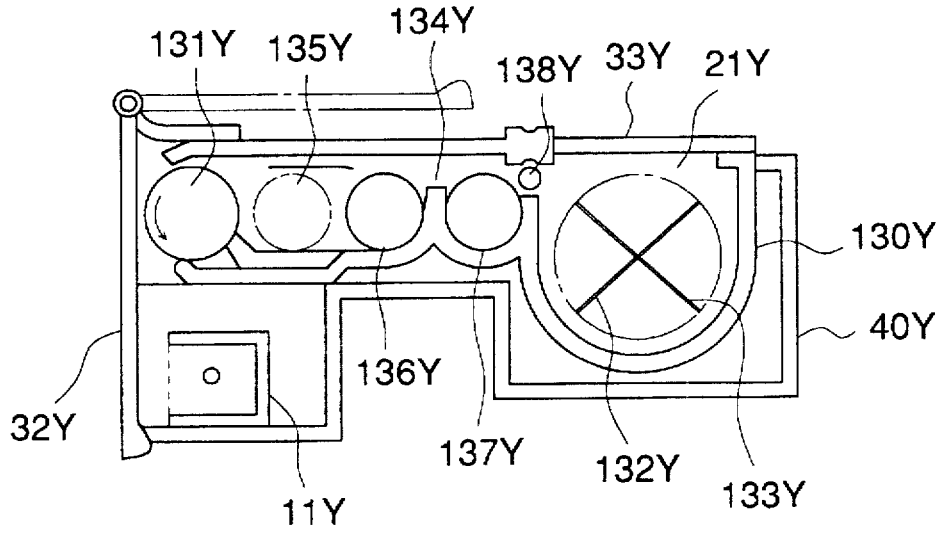

MULTI-COLOR IMAGE FORMING APPARATUS HAVING A PLURALITY OF DETACHABLE UNITS

BACKGROUND OF THE INVENTION

The present invention relates to an electrophotographic image forming apparatus in which a charging means, image exposure means and developing means are arranged around the peripheral surface of a belt-like image forming body, and thereby an image is formed in an image forming apparatus such as a copier, printer, FAX or the like. Specifically, the present invention relates to an electrophotographic color image forming apparatus in which a plurality of charging means, image exposure means and developing means are arranged around the image forming body, and a color image is formed by superimposing toner images on the image forming body during one rotation of the image forming body.

Conventionally, as one of several multi-color image forming methods, the following is obvious to skilled persons: a color image forming apparatus in which charging, image exposing and developing are successively conducted during a single rotation of a photoreceptor image forming in order to form a color image.

However, in the above-described color image forming apparatus, although high speed image formation can be carried out, as a multi-color image forming method, it is necessary to provide plural pairs of chargers, image exposure means and developing devices around the periphery of the photoreceptor. Further, there is a possibility that an optical system for conducting the image exposure becomes dirty from toner leaking from developing devices close to the optical system, with the image quality thereby being lowered. Therefore, it is required to form a larger gap between the image exposure means and the developing device in order to avoid the above-described disadvantage, and accordingly, the diameter of the photoreceptor essentially becomes larger, resulting in a large sized apparatus. In order to avoid this disadvantage, Japanese Patent Publication Open to Public Inspection No. 307307/1993 ("JP 307307") discloses; an apparatus, in which a base body of the image forming body is made of transparent material. A plurality of image exposure means are accommodated in the base body, and an image is exposed on a photosensitive layer formed on the outer periphery of the transparent base body.

However, in the apparatus of JP 307307 since the plurality of image exposure means are arranged inside the image forming body, and since the plurality of chargers and developing devices are arranged outside the image forming body, the structure becomes complex. Further, it is difficult to maintain the positional accuracy between respective units, which is also disadvantageous.

Further, the apparatus of JP 307307 requires frequent maintenance operations such as cleaning the charger for stable corona discharging, and replenishing developer or replacing developer having a shorter life than that of a photoreceptor. In order to carry out these maintenance operations, mounting and dismounting of the charger, the developing devices and replenishing tanks are required. These operations are troublesome and the handling of the apparatus is not easy.

The first object of the present invention is to provide a color image forming apparatus in which maintenance or replacement operations of chargers or developing devices, and replenishment operations of developer are easy, and which can produce an excellent color image by superimposition of toner images.

In the image forming apparatus in which a belt-shaped photoreceptor is used as the image forming body, the second object of the present invention is to provide a color image forming apparatus in which a position of a sheet feed/delivery section is improved corresponding to the size reduction of the apparatus.

In the apparatus in which a belt photoreceptor is used as an image forming body of the image forming apparatus, the following structure is used: a transparent member to prevent lifting of the belt photoreceptor at a position facing the image exposure means is provided between the image exposure means, provided inside the belt photoreceptor, and the belt photoreceptor is supported by the transparent member. However, in this case, toner conveyed around the end portions of the belt photoreceptor enters between the belt photoreceptor and the transparent member. When the belt photoreceptor is rubbed with the transparent member, a surface-like toner stain or spot-like toner stain may be formed so that the transparent member becomes dirty. Accordingly, an excellent image forming optical system can not be obtained, and nonuniform image exposures or image streaks occur, resulting in unacceptable images.

In the image forming apparatus in which the image exposure means is arranged inside the belt photoreceptor, which is an image forming body, it is required that a gap, between the exposure optical system, which is an image exposure means, and the belt photoreceptor be formed and maintained with an accuracy of ±50 μm. In this case, the belt is lifted depending on positioning of the exposure optical system and the image forming body, registration of the image exposure or the image forming position changes, and an excellent latent image formation can not be carried out, which is a problem.

The third object of the present invention is to provide a transparent member which does not stain, and to provide a high accurate positioning means for the exposure optical system and the belt photoreceptor so that no belt lifting occurs, and to maintain this positional relationship, thereby, to provide an image forming apparatus in which an excellent image can be obtained.

SUMMARY OF THE INVENTION

The first object of the present invention is attained by a color image forming apparatus in which: plural pairs of charging means and developing means are arranged outside an image forming body for forming a latent image, and a plurality of image exposure means are arranged inside the image forming body; the image forming body being charged by the charging means; the image forming body being image-exposed by the image exposure means; a toner image being formed on the image forming body by development using the developing means; and after an image is formed by superimposing the toner images on the image forming body by repeating this toner image formation process, the image being collectively transferred onto a transfer material by a transfer means, the color image forming apparatus characterized in that: the plural pairs of charging means and developing devices per color used in the color image forming apparatus are integrally formed respectively into one unit per color which can be attached to and detached from the color image forming apparatus main body.

The second object of the present invention is attained by a color image forming apparatus in which: plural pairs of charging means and developing means are arranged outside an image forming body for forming an latent image, and a plurality of image exposure means are arranged inside the image forming body; the image forming body being charged by the charging means; the image forming body being image-exposed by the image exposure means; a toner image being formed on the image forming body by development using the developing means; and after an image is formed by superimposing the toner images on the image forming body by repeating this toner image formation process, the image being collectively transferred onto a transfer material by a transfer means, the color image forming apparatus characterized in that: the image forming body is belt-like; the belt-like image forming body is wound around upper and lower rollers and vertically arranged; plural pairs of developing devices are vertically arranged in the direction of width of the image forming body on one side of the vertically arranged image forming body; and a sheet delivery section is arranged along the other side of the image forming body.

The third object is attained by an image forming apparatus in which a belt-like image forming body to form a latent image, and an image exposure means which is arranged inside the belt-like image forming body, and by which image exposure is carried out from the rear surface of the belt-like image forming body, are provided, the image forming apparatus characterized in that: a transparent member having a convex portion outside a transmission area of image exposure lights, is provided between the belt-like image forming body and the image exposure means while being in contact with the belt-like image forming body.

Further, the above-described third object is attained by an image forming apparatus in which a belt-like image forming body to form a latent image, and an image exposure means which is arranged inside the belt-like image forming body, and by which image exposure is carried out from the rear surface of the belt-like image forming body, are provided, the image forming apparatus characterized in that: a cleaning means for the transparent member is provided on the transparent member.

Still further, the above-described third object is attained by an image forming apparatus in which a belt-like image forming body to form a latent image, and a plurality of image exposure means which are arranged inside the belt-like image forming body, and by which image exposure is carried out from the rear surface of the belt-like image forming body, are provided, the image forming apparatus characterized in that: a holding member to hold the plurality of image exposure means, a pressing means to press the holding member, and a transparent member which contacts the belt-like image forming body, are provided; the holding member, the image exposure means and the transparent member are integrally connected; and the belt-like image forming body is pressed by the pressing means through the transparent member.

BRIEF DESCRIPTION OF THE DRAWINGS

FIGS. 8(A) and 8(B) are views showing an example of a transparent member.

FIG. 9(A) and 9(B) are views showing another example of the transparent member.

FIGS. 10(A) and 10(B) are views showing an example to remove stain.

FIGS. 20(A) and 20(B) are views showing developing devices used in the color image forming apparatus shown in FIG. 18.

DETAILED DESCRIPTION OF THE PREFERRED EMBODIMENT

Figure 1:
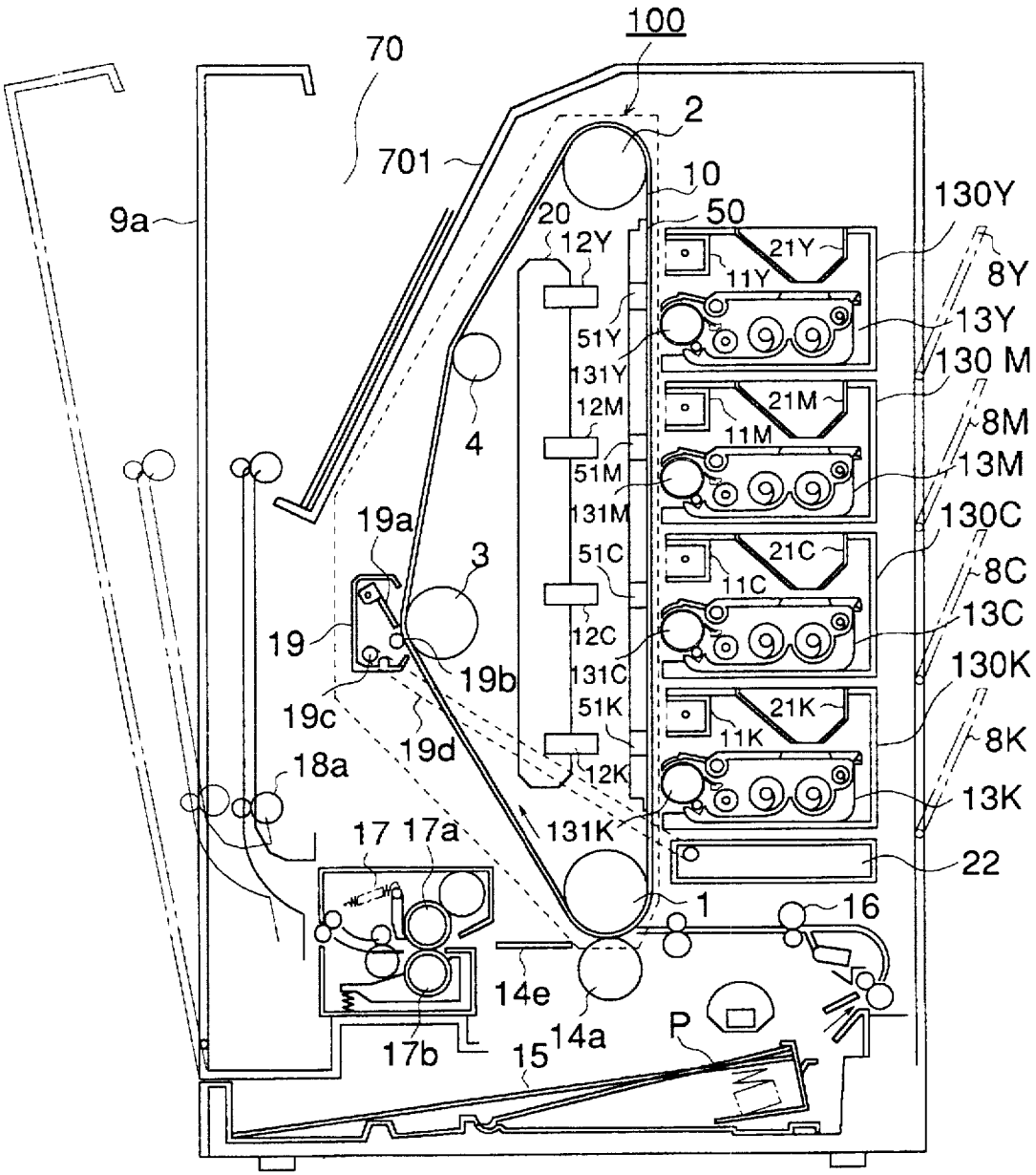
FIG. 1 is a sectional structural view of a color image forming apparatus showing an example of the present invention.

Referring to FIG. 1, image forming processes and mechanisms of one example of the image forming apparatus to attain the first and second objects of the present invention, will be described below using a color image forming apparatus shown in FIG. 1. FIG. 1 is a sectional view showing the structure of a color image forming apparatus which is one example of the present invention. In the image forming apparatus of the present invention, a base body of a belt-like photoreceptor, which is an image forming body, is formed of transparent material, a belt photoreceptor in which a photoreceptor layer is provided on the outer peripheral surface of the transparent base body, is used. An image formation process means is arranged such that an image exposure means is provided inside the belt photoreceptor, and chargers, developing devices, a transfer unit and a cleaning unit are arranged outside the belt photoreceptor.

The belt photoreceptor 10 which is a belt-like image forming body as an image forming body, is formed such that, for example, an endless belt-like base body formed of transparent polyimide resin or the like is provided inside the belt photoreceptor, and a photoreceptor layer such as a transparent electro-conductive layer, a-Si layer, an organic photoreceptor layer (OPC) or the like, is formed on the outer periphery of the belt. The transparent base body of the belt photoreceptor 10 is used as the inner surface of the belt photoreceptor. The belt photoreceptor 10 is wound around a drive roller 1, driven rollers 2 and 3, a tension roller 4 and a supporting member 50 provided between the drive roller 1 and the driven roller 2. The belt photoreceptor 10 is rotated clockwise under the condition that the surface of the belt photoreceptor 10 on which charging, exposing, developing processes are carried out, is pressed by the supporting member 50. Exposure scanning holes 51Y, 51M, 51C and 51K are provided in the supporting member 50.

In the present example, the transparent base body may have only an amount of exposure, the wavelength of which can form an appropriate contrast with light attenuation characteristics of a light conductive layer (light carrier generation), in a light conductive layer of the belt photoreceptor 10 which is an image forming point of exposure beams for image exposure. Accordingly, it is not necessary that a light transparency factor of a transparent base body of the belt photoreceptor 10 be 100 %, but may have a characteristic in which some amount of light is absorbed at the time of transmission of the exposure beam. As light transmissive base body materials, any type of light transmissive resins such as polyimide, fluorine, polyester, polycarbonate, polyethylene terephtalate, etc., can be used. As a light transmission conductive layer, indium, tin oxide (ITO), lead oxide, indium oxide, copper iodide, or a metallic film, in which light permeability is maintained, and which is formed of Au, Ag, Ni, Al, etc., can be used. As film forming methods, a vacuum deposition method, an activated reaction deposition method, any type of spattering method, any type of CVD method, a dip coating method, a spray coating method, etc., can be used. As light conductive layers, an amorphous silicon (a-Si) alloy photoreceptor layer, an amorphous selenium alloy photoreceptor layer, or any type of organic photoreceptor layer (OPC), can be used.

Scorotron chargers 11Y, 11M, 11C, and 11K which are charging means, are used for each respective color image formation process of yellow (Y), magenta (M), cyan (C) and black (K), and uniformly charge the belt photoreceptor 10 by corona discharge using a control grid and a discharge wire, which has a predetermined potential voltage with respect to the organic photoreceptor layer on the belt photoreceptor 10.

Exposure optical systems 12Y, 12M, 12C, and 12K which are image exposure means, are composed of: linear FLs (fluorescent substance emitting element), ELs (electroluminescence element), PLs (plasma discharging element), LEDs (light emitting diode), in which light emitting elements are arranged in the shape of an array in the direction of width of the belt photoreceptor 10; exposure elements such as LISA (photoelectro-magnetic effect optical shutter array), PLZT (transparent piezoelectric shutter array), LCS (liquid crystal shutter), etc. in which elements having optical shutter functions are linearly arranged; and a Selfoc lens as a life-sized image formation element. The exposure optical systems are formed into a unit, and mounted on a holding member 20 provided inside the belt photoreceptor 10. Each color image signal read by an image reading device, which is separately provided from the apparatus, is successively read from a memory and is inputted into exposure optical systems 12Y, 12M, 12C, and 12K as an electric signal. The wavelength of light beams from the light emitting elements used in this example is within 600 to 900 nm.

Developing devices 13Y, 13M, 13C and 13K, which are developing means using a noncontact developing method, and in which one component or two-component developers for yellow (Y), magenta (M), cyan (C) and black (K) are respectively accommodated, are vertically arranged on one side of the belt photoreceptor 10 which is vertically provided, in parallel to the belt surface, and in the direction perpendicular to the movement of the belt photoreceptor 10. The developing devices respectively have developing sleeves 131Y, 131M, 131C and 131K which are rotated in the same direction as the belt photoreceptor 10 while keeping a predetermined gap with respect to the peripheral surface of the belt photoreceptor 10.

The developing devices 13Y, 13M, 13C and 13K reversal-develop an electrostatic latent image formed on the belt photoreceptor 10, which is formed by charging using scorotron chargers 11Y, 11M, 11C and 11K, and by image exposing using exposure optical systems 12Y, 12M, 12C and 12K, under noncontact condition by application of the development bias voltage.

A document image is read by an image reading apparatus which is provided separately from the apparatus. An image read by an image pickup element, or an image edited by a computer is temporarily stored in a memory as image signals of Y, M, C and K.

When image recording starts, a photoreceptor driving motor rotates, and the belt photoreceptor 10 is rotated clockwise. Simultaneously, application of the potential voltage onto the belt photoreceptor 10 starts by a charging operation of the scorotron charger 11Y.

After the potential voltage has been applied onto the belt photoreceptor 10, exposure corresponding to the first color signal, that is, exposure due to an electric signal corresponding to a yellow (Y) image signal starts, and an electrostatic latent image corresponding to a document yellow (Y) image is formed on the photoreceptor layer by rotational scanning on the belt photoreceptor 10.

The electrostatic latent image is reversal-developed under the non-contact condition of the developer on the developing sleeve by the developing device 13Y, and a yellow (Y) toner image is formed corresponding to the rotation of the belt photoreceptor 10.

A potential voltage is applied onto the yellow (Y) toner image on the belt photoreceptor 10 by a charging action of the scorotron charger 11M. Exposure due to an electric signal corresponding to the second color signal of the exposure optical system 12M, that is, corresponding to a magenta (M) image signal, is carried out. The magenta (M) toner image is successively superimposed on. the yellow (Y) toner image by the non-contact reversal development using the developing device 13M.

In the same process, a cyan (C) toner image corresponding to the third color signal is formed by being superimposed on the magenta toner image by the scorotron charger 11C, exposure optical system 12C and developing device 13C. Further, a black (K) toner image corresponding to the fourth color signal is successively formed by being superimposed on the cyan toner image by the scorotron charger 11K, exposure optical system 12K and developing device 13K, and a color toner image is formed on the peripheral surface of the belt photoreceptor 10 during a single rotation.

Exposure onto the organic photoreceptor layer of the belt photoreceptor 10 by the exposure optical system 12Y, 12M, 12C and 12K is carried out from the inside of the belt photoreceptor through the transparent base body. Accordingly, exposure of the image corresponding to the second, third, and fourth color signals is carried out without any influence from the previously formed toner images, and an electrostatic latent image, which is equivalent to the image corresponding to the first color signal, can be formed. Temperature stabilization and prevention of the rise of temperature in the belt photoreceptor 10 due to heat generation of the exposure optical systems 12Y, 12M, 12C and 12K, can be controlled to the degree in which no interference occurs, by countermeasures in which materials having excellent heat conductivity are used for the supporting member 20, a heater is used at low temperatures, or heat is released outside the apparatus through a heat pipe at high temperatures.

Replenishment developers for each color are respectively supplied from replenishment tanks 21Y, 21M, 21C and 21K to developing devices 13Y, 13M, 13C and 13K. Development operations of developing devices 13Y, 13M, 13C and 13K are carried out as follows. A DC developing bias voltage, or an AC developing bias voltage which is superimposed on the DC bias voltage, is applied on the developing sleeves 131Y, 131M, 131C and 131K; jumping development by one component or two-component developer accommodated in the developing devices is carried out; a DC bias voltage having the same polarity as the toner is applied onto the belt photoreceptor 10 in which the transparent electro-conductive layer is electrically grounded; and non-contact reversal development is carried out so that toner adheres to the exposed portion.

The color toner image thus formed on the peripheral surface of the belt photoreceptor 10, is transferred onto a transfer sheet P by a transfer roller 14*a* as a transfer unit, in a transfer section, wherein the transfer sheet P is fed by a sheet feed cassette 15, conveyed to a timing roller 16, and is then fed in timed relationship with the toner image on the belt photoreceptor 10 by the timing roller 16. The transfer roller 14*a* is controlled as follows. The transfer roller 14*a* is synchronized with the transfer sheet P fed to the transfer section by the timing roller 16. The transfer roller 14*a* pressure-contacts the belt photoreceptor only while transfer is carried out in the peripheral direction of the belt photoreceptor 10 for the length corresponding to the length of the transfer sheet P. The transfer roller 14*a* is controlled by a control section, provided in the image forming apparatus and not shown in the drawing, and a pressure contact release mechanism of the transfer roller so that the transfer roller 14*a* is separated from the belt photoreceptor 10 while the transfer process is not being carried out.

After the transfer sheet P on which the toner image is transferred, has been separated from the peripheral surface of the belt photoreceptor 10 by using the radius of curvature of the driving roller 1, the transfer sheet P is conveyed to a fixing unit 17 by a conveyance belt 14*e*. In the fixing unit 17, the transfer sheet P is heated and pressure-contacted, and toner is fused and fixed onto the transfer sheet P. After that, the transfer sheet P is delivered from the transfer unit 17, conveyed by delivery sheet conveyance rollers 18*a* and 18*b*, and delivered onto a tray in the upper portion of the apparatus through a sheet delivery roller 18.

The surface of the belt photoreceptor 10 from which the transfer sheet is separated, is slidably contacted with a cleaning blade 19*a* and a cleaning roller 19*b* in a cleaning unit 19, and the residual toner is thereby removed and the surface of the belt photoreceptor is cleaned. The toner image of the document image is continuously formed on the belt photoreceptor, or the belt photoreceptor temporarily stops for toner image formation of a new document image. Waste toner scraped off the cleaning blade 19*a* and the cleaning roller 19*b* is delivered to a waste toner container 22 by a toner conveyance screw 19*c* and a toner conveyance pipe 19*d*. After cleaning, the cleaning blade 19*a* and the cleaning roller 19*b* are maintained under the condition that these are separated from the belt photoreceptor 10 to prevent the belt photoreceptor 10 from being damaged.

The transfer sheet P on which a color image is formed, is taken out from an opening 70 provided in the upper portion of the apparatus main body. When jamming occurs on the sheet delivery path, a left door 9*a* onto which a pair of delivery sheet conveyance rollers 18*a* and delivery sheet rollers 18 are integrally attached, is opened for jam processing. The pressure contact of a fixing roller 17*a* to a pressure contact roller 17*b* is released by the pressure contact release mechanism, not shown in the drawing, corresponding to opening of the door 9*a*, and jamming in the fixing section is processed.

A scorotron charger 11Y, a developing device 13Y and a supply tank 21Y for image formation are integrally provided in a developing unit 130Y. In the same way for magenta (M), cyan (C), and black (K), scorotron chargers 11M, 11C, 11K, developing devices 13M, 13C, 13K, and supply tanks 21M, 21C, 21K are integrally provided respectively in developing units 130M, 130C and 130K.

Figure 2:
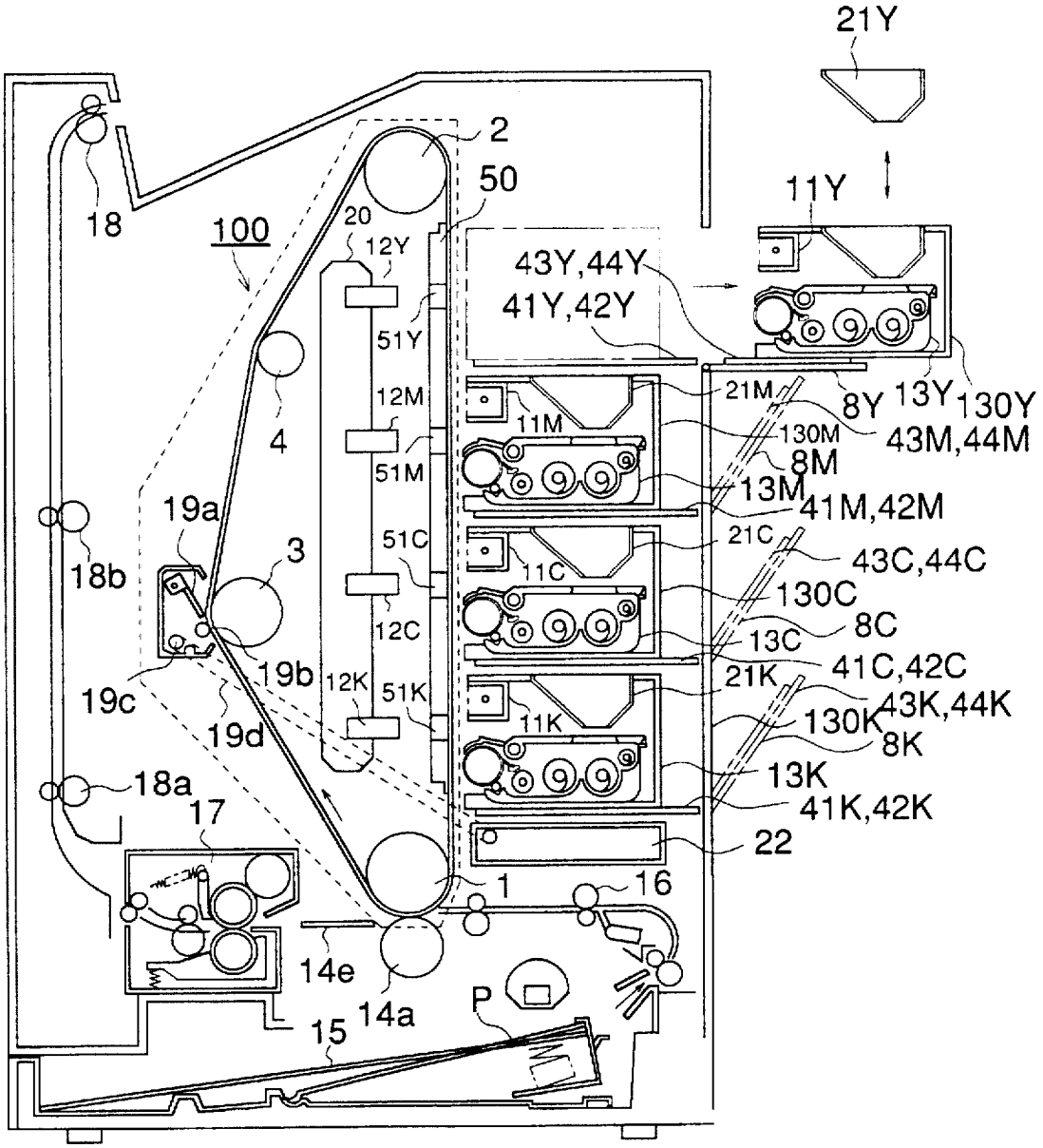
FIG. 2 is a view showing a method to attach or detach a developing unit used in the present invention.

When maintenance or replacement are carried out, a door 8Y for developing unit mounting/dismounting, provided on the right side in FIG. 2 is opened, and a developing unit 130Y is pulled out on front and rear guide rails 41Y, 42Y (not shown in the drawing) provided in the apparatus main body, which are engaged with 2 guide slots (not shown in the drawing) provided on the developing device 13Y. Further, the developing unit 130Y is pulled outside the apparatus main body on guide rails 43Y, 44Y (not shown in the drawing) provided on the door 8Y until the developing unit 130Y contacts a stopper (not shown in the drawing) provided on the door 8Y, and mounted into or dismounted from the apparatus main body. Then, cleaning and replacement of scorotron chargers, maintenance and replacement of developing devices and replenishment tanks, or replenishment of developer or toner to the replenishment tanks, are carried out.

Cleaning and replacement of scorotron chargers, maintenance and replacement of developing devices and replenishment tanks, or replenishment of developer or toner to the replenishment tanks, can also be carried out without dismounting the developing unit 130Y from the apparatus main body, and can be carried out under the condition that the developing unit 130Y is located on guide rails 43Y, 44Y provided on the door 8Y, resulting in easy maintenance operations. Specifically, the replacement of the replenishment tank 21Y becomes easier. In the same manner, mounting or dismounting, or maintenance of the developing units 130M, 130C and 130K can be carried out.

Further, the shape and structure of the developing units 130Y, 130M, 130C and 130K can be made the same as each other, and when their shape and structure are the same, the developing units 130Y, 130M, 130C and 130K can be replaced with each other.

Figure 5:
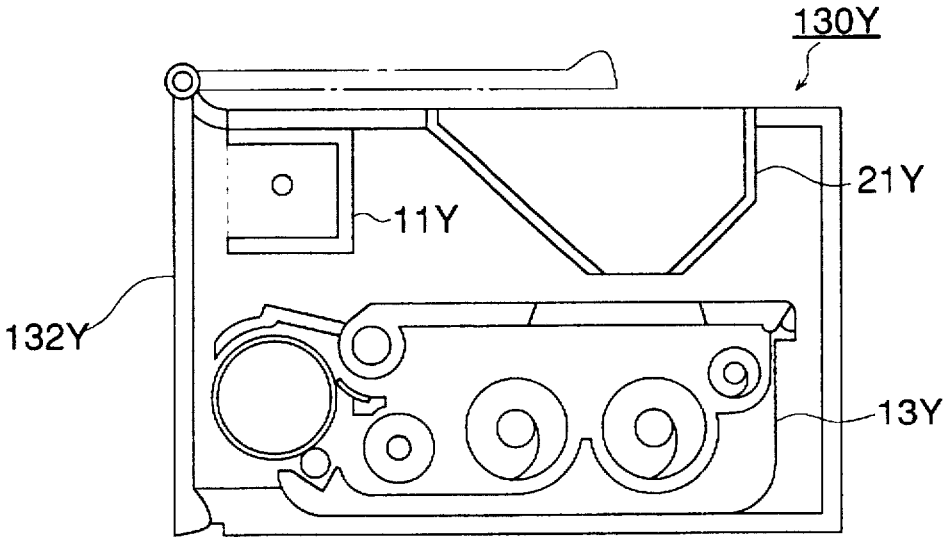
FIG. 5 is a view showing the developing unit and its protection cover.

As shown in FIG. 5, a protection cover 132*y* is provided on the developing unit 130Y in which the scorotron charger 11Y, developing device 13Y and the replenishment tank 13Y are integrally provided. When the developing unit 30Y is mounted, the protection cover 132Y is opened to the position shown by one-dotted chain line, and the developing unit 130Y can be mounted into the apparatus main body.

When maintenance or replacement of the belt photoreceptor and the exposure optical systems is carried out, a front cover, not shown in the drawing, is opened and a belt photoreceptor unit 100, shown by a dotted line in FIG. 1, is pulled out to the viewer's side in the drawing after developing devices 13Y, 13M, 13C, 13K and scorotron chargers 11Y, 11M, 11C and 11k are retreated to the right side in the drawing. In this case, a connected portion, not shown in the drawing, connected to a waste toner tank 22, which is provided to a toner conveyance pipe 19*d*, is disconnected.

A frame 101 is provided around the belt photoreceptor unit 100, and a drive roller 1, driven rollers 2, 3 and a tension roller 4 are fixed to the frame 101. The belt photoreceptor 10 are wound around each roller. A cleaning unit 19 is provided outside the belt photoreceptor 10, and a supporting member 50 for supporting the belt photoreceptor 10 is provided inside the belt photoreceptor 10, and they are respectively fixed inside the frame 101. Further, exposure optical systems 12Y, 12M, 12C and 12K fixed on the holding member 20 under the condition that they are included in the belt photoreceptor 10, are attached facing exposure openings 51Y, 51M, 51C and 51K provided on the supporting member 50. A gear G1, rotated by a drive motor, not shown in the drawing, which is provided in the image forming apparatus main body and connected to the drive roller 1, is provided outside the frame 101.

A combination hole 103 for developing devices 13Y, 13M, **13*c* and 13*k*, and scorotron chargers 11Y, 11M, 11C and 11K, a clearance hole 104 which allows for operation of the transfer roller 14*a*, and a hole 102 for mounting/dismounting of the holding member 20 on which the exposure optical systems 12Y, 12M, 12C and 12K are fixed, are provided in the frame body 101. When the holding member 20 is installed into the frame body 101**, the holding member is fixed by an engagement member, not shown in the drawing.

When the holding member 20 onto which the exposure optical systems 12Y, 12M, 12C and 12K are fixed, is mounted into or dismounted from the hole 102 of the frame 101, holes 210 and 220 provided in the holding member 20 are respectively engaged with or disengaged from supports 105 and 106 provided in the frame body 101, and the exposure optical systems 12Y, 12M, 12C and 12K, and the belt photoreceptor 10, wound around the holding member 50, are accurately positioned relative to each other.

Figure 4:
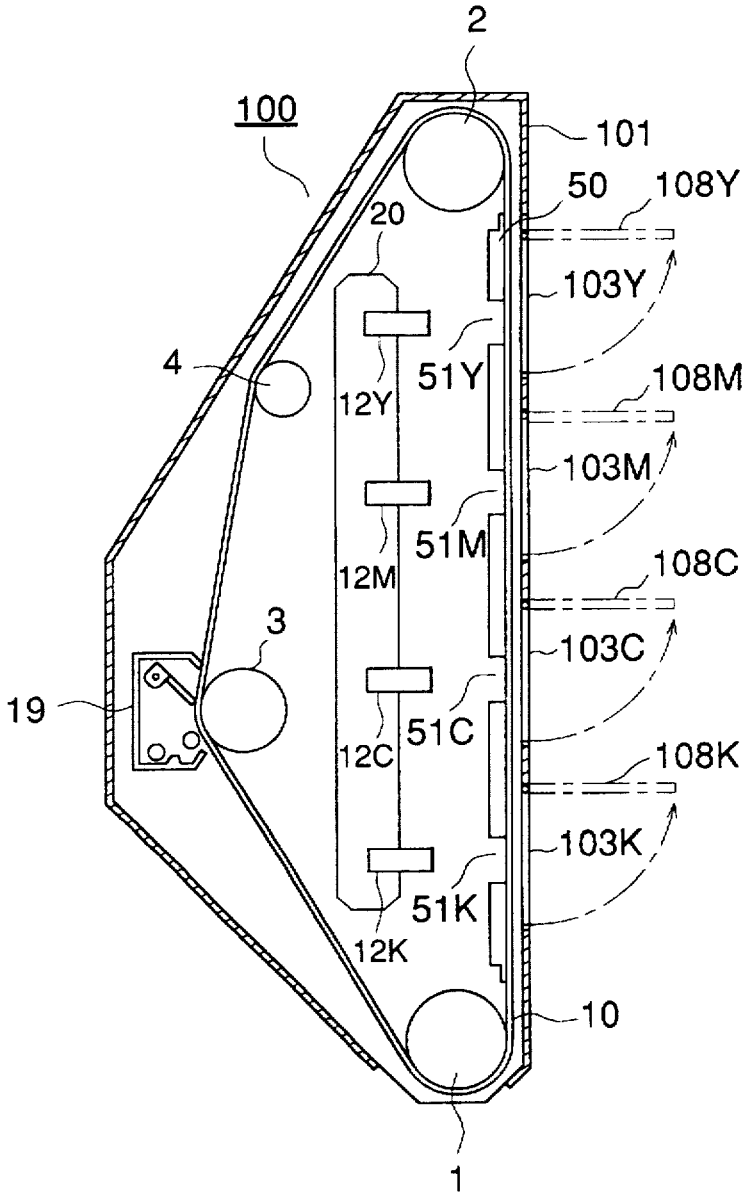
FIG. 4 is a view showing a protection cover of the belt photoreceptor unit shown in FIG. 3.

As shown in FIG. 4, protection covers 108Y, 108M, 108C and 108K may be provided on a belt photoreceptor unit 100 in which the belt photoreceptor 10 and the holding member 20, on which exposure optical systems 12Y, 12M, 12C and 12K are fixed under the condition that these systems are included inside the belt photoreceptor 10, are integrated. When the belt photoreceptor unit 100 is mounted, the protection covers 103Y, 103M, 103C and 103K are opened to a position shown by a one-dotted chain line, and the belt photoreceptor unit 100 is mounted into the apparatus main body. In this case, developing units 130Y, 130M, 130C and 130K are mounted after the belt photoreceptor unit 100 has been mounted.

Figure 6:
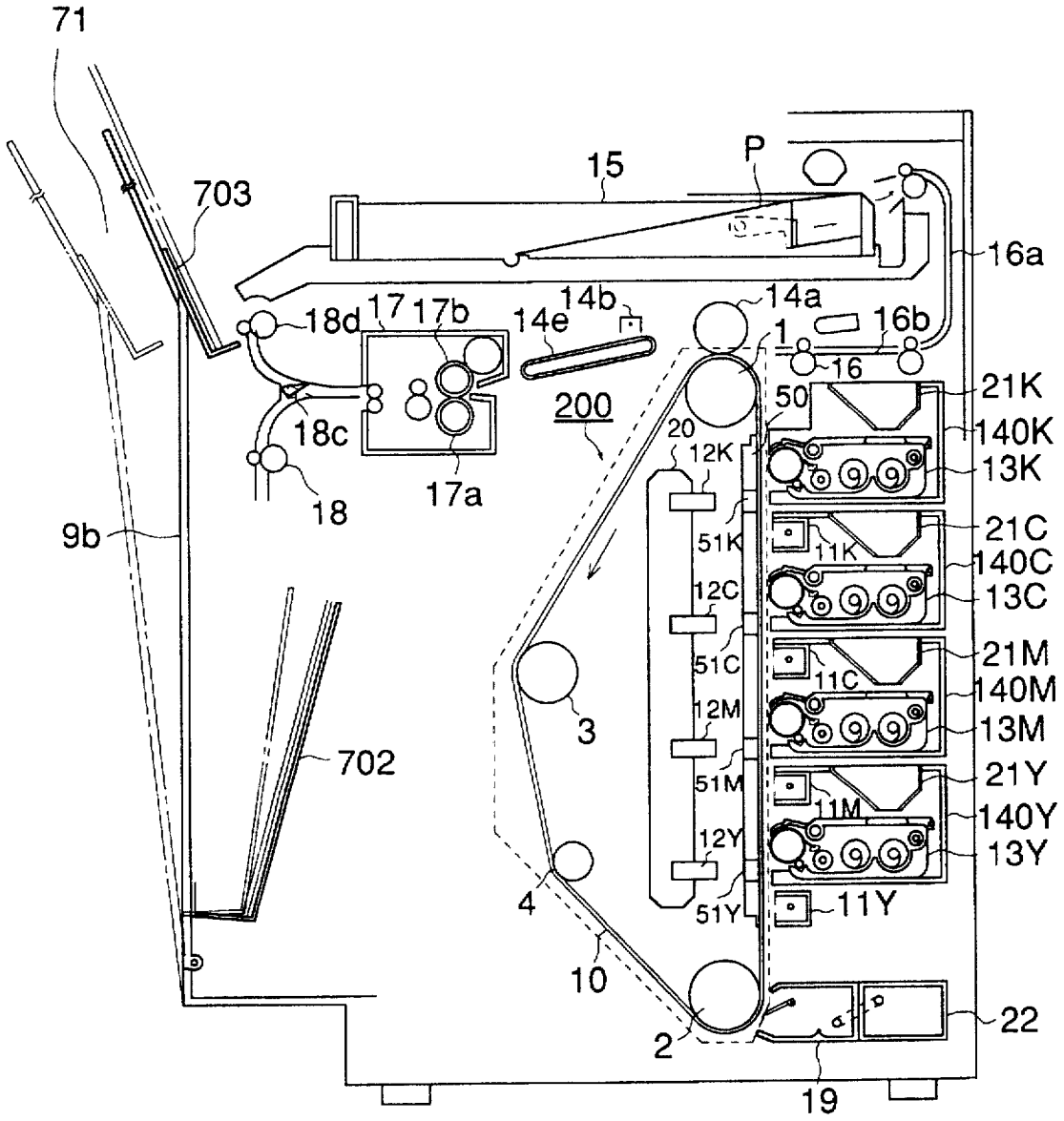
FIG. 6 is a sectional structural view of a color image forming apparatus showing another example of the present invention.
Figure 7:
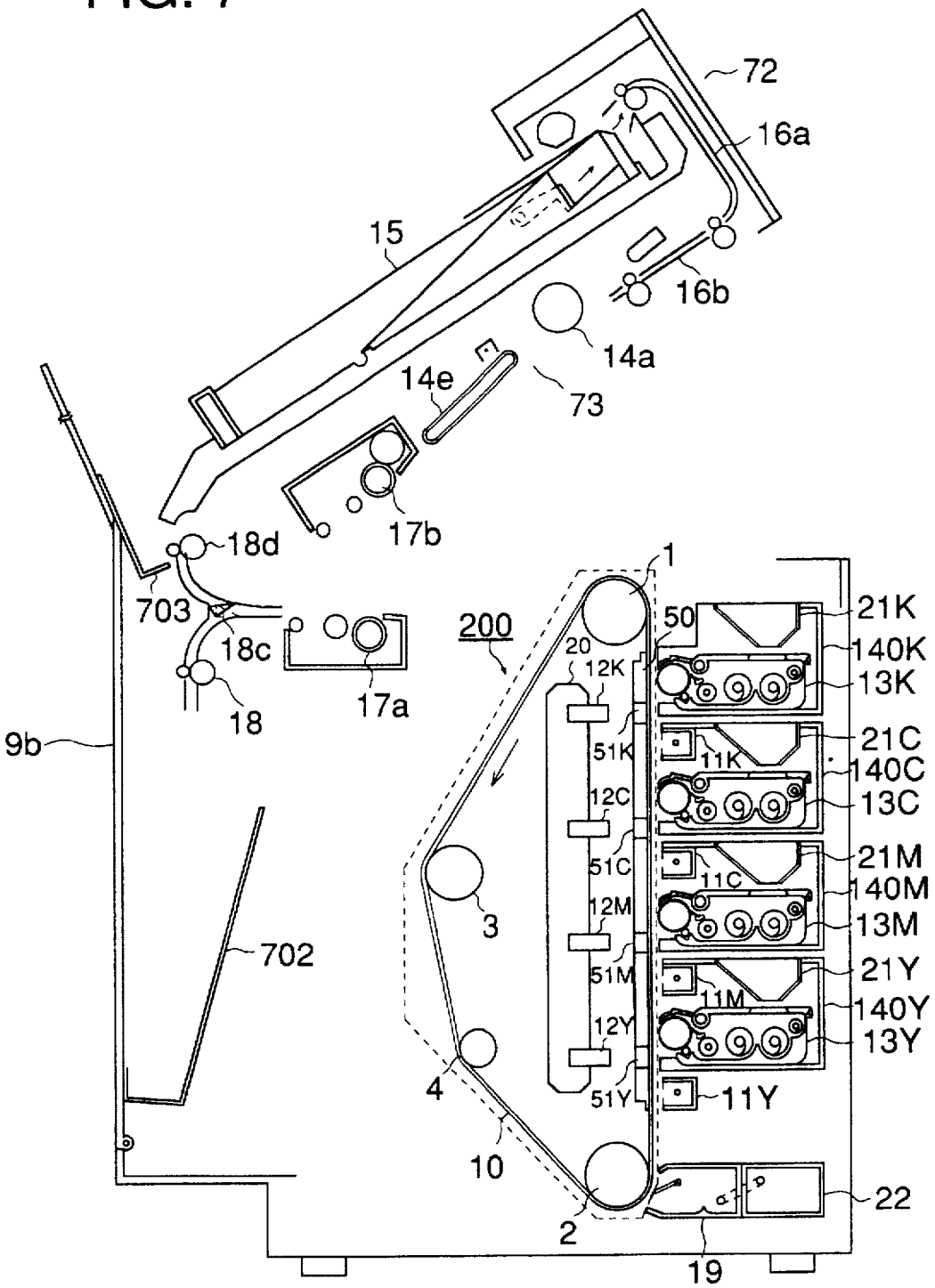
FIG. 7 is a view showing a status in which an upper portion of the apparatus main body shown in FIG. 6 is opened.

Referring to FIGS. 6 and 7, to attain the second object of the present invention, another example of the color image forming apparatus constituting the present invention will be described below. FIG. 6 is a sectional view of a color image forming apparatus showing another example of the present invention. FIG. 7 is a view showing the status in which an upper portion of the apparatus main body in FIG. 6 is opened. In the color image forming apparatus of this example, image formation is carried out in the same process as the image formation process described in FIG. 1. However, in addition, a sheet feed device, a transfer unit, and a fixing unit are provided in the upper portion. The belt photoreceptor is rotated counterclockwise corresponding to the movement direction of the transfer sheet in the transfer section. Accordingly, image formation processing means such as developing devices, chargers, and exposure optical systems which are parallel to the belt photoreceptor, are respectively arranged vertically from the lower portion in the order of Y, M, C, and K. The same numerical codes are denoted for members having the same function and structure as the corresponding members shown in FIG. 1.

The belt photoreceptor 10, which is the image forming body and the inner surface of which is formed of transparent base, is wound around the upper drive roller 1, the lower driven roller 2, the intermediate driven roller 3, the tension roller 4, and the supporting member 50 provided between the drive roller 1 and the driven roller 2, and is arranged vertically. The belt photoreceptor 10, which is subjected to charging, exposing, and developing processing, is rotated counterclockwise while its inner surface is being pressed against the supporting member 50. The color image forming process is conducted by the same members and means as those in the above-described example.

The color toner image formed on the peripheral surface of the belt photoreceptor 10 is transferred onto a transfer sheet P which is a transfer material, fed from a sheet feed cassette 15, which is a sheet feeding device provided in the upper portion of the color image forming apparatus main body, conveyed to a timing roller 16, and is fed in timed relationship with the toner image on the belt photoreceptor 10 by drive of a timing roller 16, in the transfer section. The transfer roller **14*a* is in timed relationship with the transfer sheet P fed to the transfer section by the timing roller 16. The transfer roller 14*a* is in pressure-contact with the belt photoreceptor 10 while the transfer operation is carried out for the length of the transfer sheet P in the peripheral direction of the belt photoreceptor 10. The transfer roller 14*a* is operated by a control section, not shown in the drawing, provided in the image forming apparatus, and a contact-pressure release mechanism, so that the transfer roller 14*a* is separated from the belt photoreceptor 10** when the transfer process is not conducted.

After the transfer sheet P, onto which the toner image has been transferred, is separated from the belt photoreceptor 10 due to the radius of curvature of the drive roller 1, it is attracted onto a conveyance belt **14*e*, which is electrically charged by a belt charger 14*b*, and conveyed while the toner image on the transfer sheet P faces downward. The transfer sheet P is separated from the conveyance belt 14*e* by the separation claw 14*g* of the conveyance section, conveyed to the fixing device 17, and heated and pressure-contacted by a fixing roller 17*a* and a pressure-contact roller 17*b* in the fixing device so that toner is fused and fixed on the transfer sheet P. Then, it is delivered from the fixing device 17. The transfer sheet P on which toner is fixed, is delivered by a paired delivery rollers 18 onto a sheet delivery section 702 provided on the back of the side surface, opposite to the side in which the developing devices 13Y, 13M, 13C and 13K are arranged, with respect to the belt photoreceptor 10, while the toner surface on the transfer sheet P faces downward and the leading edge of the image is positioned downward. The transfer sheet P on which a color image was formed, is taken out from an opening 71 after a left door 9*b* in FIG. 6, onto which the sheet delivery section 702** is integrally fixed, is opened.

Further, when a delivery path switching member **18*c*, provided at the exit of the fixing device, is switched to the position, shown by a dotted line, by a switching means through the control section and mechanical member, for example, by selecting an operation button or an operation panel in an operation section, not shown in the drawing, then, the transfer sheet P on which toner is fixed, is delivered onto the sheet delivery section 703 provided at the trailing edge of the sheet feed cassette 15 through the paired sheet delivery rollers 18*d*** while the toner surface on the transfer sheet P faces downward, and the leading edge of the image faces upward.

The developing unit 140Y in which the developing device 13Y and the replenishment tank 21Y are integrated, is provided in the apparatus. In the same manner for magenta (M), cyan (C), and black (K), developing devices 13M, 13C, 13K, and replenishment tanks 21M, 21C, 21K are respectively integrated, are also provided in the apparatus.

For maintenance and replacement, developing units 140Y, 140M, 140C and 140K can be mounted or dismounted when the door for mounting or dismounting developing units, not shown in the drawing, provided in the right in FIG. 6 is opened. Maintenance, replacement of developing devices, or replenishment of developer to the replenishment tanks can also be carried out through this door. Further, cleaning or replacement of the scorotron chargers is also carried out when this door is opened.

When maintenance or replacement of the belt photoreceptor and the exposure optical systems is carried out, after developing devices 13Y, 13M, 13C and 13K, and scorotron chargers 11Y, 11M, 11C and 11K are respectively retreated to the right as shown in FIG. 7, the apparatus is opened under the condition that the upper portion 72 of the apparatus including the sheet feed cassette 15, sheet feed conveyance sections **16*a*, 16*b*, timing roller 16, transfer roller 14*a*, conveyance belt 14*e* and the pressure-contact roller 17*b* of the fixing device, is separated from the lower portion including the fixing roller 17*a* of the fixing device 17, wherein the fixing device 17 is divided into the upper portion including the pressure-contact roller 17*b* and the lower portion including the fixing roller 17*a*. The belt photoreceptor unit 200 shown by a dotted lines in FIG. 7 is removed upwardly. A horizontal transfer sheet conveyance system 73 composed of the sheet conveyance section 16*b*, timing roller 16, transfer roller 14*a*, conveyance belt 14*e* and the pressure-contact roller 17*b*** of the fixing device, can be opened, thereby, jamming processing is easy.

Figure 3:
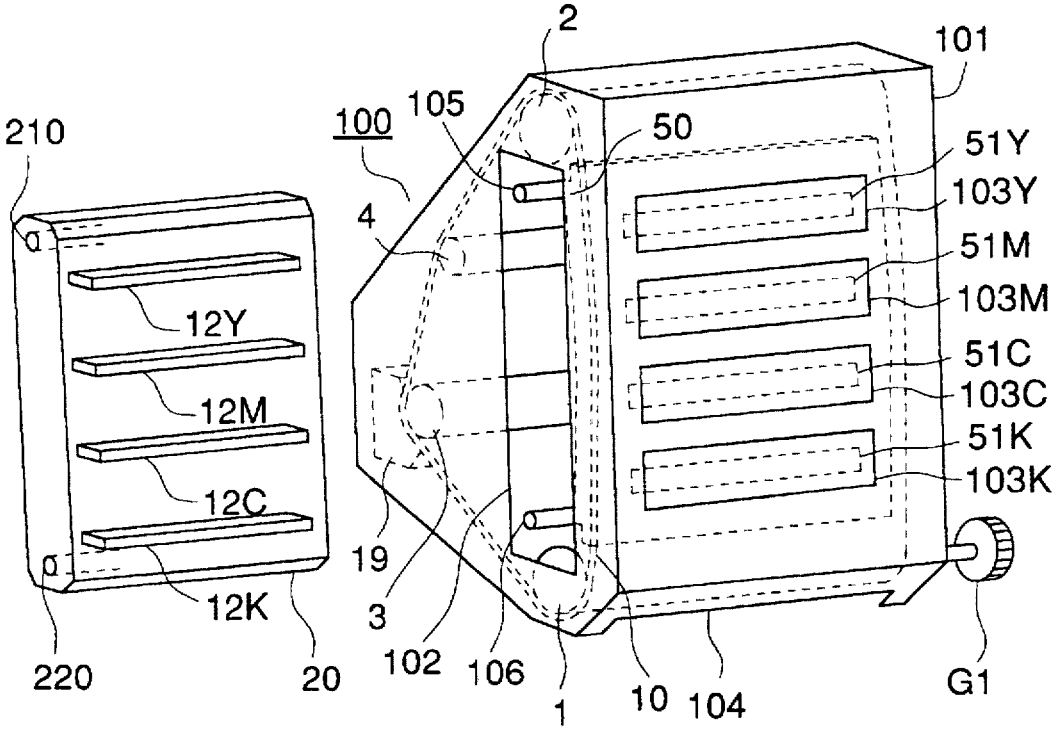
FIG. 3 is a view showing a belt photoreceptor unit used in the present invention.

The combination of the belt photoreceptor 10 and the holding member 20 onto which the exposure optical systems 12Y, 12M, 12C and 12K are fixed, in the belt photoreceptor unit 200, is the same as that of the above-described example shown in FIG. 3.

When a paper jam occurs, jam clearing is carried out when the upper portion 71 of the apparatus including the sheet feed cassette 15, sheet feed conveyance section, transfer roller **14*a*, conveyance belt 14*e* and the pressure-contact roller 17*b* of the fixing device, is hinged upward from the lower portion including the fixing roller 17*a* of the fixing device 17, wherein the fixing device is divided into an upper portion including the pressure-contact roller 17*b* and a lower portion including the fixing roller 17*a***.

Further, in any of the above-described examples, the shape of the section of the supporting member 50, which is parallel with the running direction of the belt photoreceptor 10, is preferably convex, and the belt photoreceptor 10 is in contact with the convex portion so that the belt photoreceptor 10 always closely contacts the supporting member 50.

According to the above examples, in a color image forming apparatus in which image exposure is carried out from the rear surface of the image forming body, a color image forming apparatus can be provided in which the installation area is smaller, more space saving and size reduction than that of conventional apparatus are realized by fully utilizing the three-dimensional space.

Devices such as chargers, developing devices, or replenishment tanks for which maintenance and replacement operations are frequently carried out, are structured into an integral unit for easy operations, and thereby, a color image forming apparatus, in which cleaning and replacement of chargers, maintenance and replacement of developing devices, replacement of developing tanks in which developers are accommodated, or maintenance operations such as replenishment of developer or toner are easily carried out, can be provided. Further, the positional accuracy between the image forming body and a plurality of developing devices and chargers is respectively maintained constant, thereby, a color image forming apparatus in which a desirable color image is formed, can be provided.

Referring to FIGS. 8(A) and 8(B), an example of a transparent member to which dirt is prevented, which is the third object of the present invention, will be described. FIGS. 8(A) and 8(B) are views showing one example of the transparent member, and FIGS. 9(A) and 9(B) are views showing another example of the transparent member. Since the exposure optical systems and the transparent member used for exposure optical systems have the same structure and the same function as those in each example, explanation is represented by the exposure optical system 12Y.

FIG. 8(A) shows the positional relationship of the transparent member and the exposure optical system with respect to the belt photoreceptor. FIG. 8(B) shows a perspective view of the transparent member. A transparent member 30Y, having a C-shaped section, through which image exposure light beam passes, is provided between the top edge portion for image exposure light beam radiation of the exposure optical system 12Y provided inside the belt photoreceptor 10 and the belt photoreceptor 10, in parallel with the linear exposure optical system 12Y. On the transparent member 30Y, a band-like surface 35 through which image exposure light beam passes, is provided, and projections **31*a* and 31*b* are receptively provided on both ends, which have no relation to the image exposure, of the surface 35. As described later, the transparent member 30Y is held by a holding member 20 to hold the exposure optical system 12Y or a supporting member 50, and projections 31*a* and 31*b* are arranged at both ends of the transparent member 30Y while being in contact with the belt photoreceptor 10**.

When the belt photoreceptor 10 is rotated, since the belt photoreceptor 10 contacts the projections **31*a* and 31*b* and slides thereon, the surface 35 is not directly rubbed with the belt photoreceptor 10, the contact surface area is reduced, and surface-like or spot-like toner stain is not generated, so that an excellent image having no nonuniform image exposure or image streaks, can be obtained. More preferably, in order to maintain a good sliding property with the belt photoreceptor 10, or to prevent toner adhering to projections 31*a* and 31*b*, for example, film coating of fluororesin, teflon resin, or coating by burning, in which sliding characteristics are excellent and toner adherence is extremely few, is carried out on sliding portions of the projections 31*a* and 31*b*** as a toner adherence prevention member.

FIG. 9(A) shows projections which contact with the belt photoreceptor 10, and contact portions of which are further reduced. That is, portions contacting with the image exposure scanning area, of projections shown in FIG. 8(B) are cut, and projections **31*a*, 31*b*, 31*c* and 31*d* which contact with the belt photoreceptor 10 are provided on four corners outside the image exposure scanning area, of the transparent member 301Y. In FIG. 9(B), projections 31*a* and 31*b* which contact with the belt photoreceptor 10 are provided at both ends outside the image exposure scanning area of the transparent member 302Y, through which image exposure scanning is not carried out in the image exposure scanning direction, in the same direction as the rotational direction of the belt photoreceptor 10**. Because the belt photoreceptor contacts with the projections outside the image exposure scanning area, a stain of the belt photoreceptor is reduced.

In also the example in FIGS. 9(A) and 9(B), preferably, in order to maintain a good sliding property with the belt photoreceptor 10, or to prevent toner adhering to projections, for example, film coating of fluororesin, teflon resin, or coating by burning, in which sliding characteristics are excellent and toner adherence is extremely few, is carried out on sliding portions of the projections as a toner adherence prevention member.

Next, in order to prevent a stain of the transparent member, an example of the structure to remove the stain of the transparent member will be explained using FIGS. 10(A) and 10(B). FIGS. 10(A) and 10(B) are views showing an example to remove the stain.

A bar-shaped transparent member 303Y through which image exposure light transmits, is provided in parallel to the linear exposure optical system 12Y between the leading edge of the exposure portion of the exposure optical system 12Y provided inside the belt photoreceptor 10 and the belt photoreceptor 10, wherein a transparent film 43 is sandwiched between the transparent member 303Y and the belt photoreceptor 10 and the transparent member is in pressure-contact with the belt photoreceptor 10.

The transparent film 43 which is a stain prevention means as a cleaning means, is stretched between a master roller 41 and a winding roller 42, and when the belt photoreceptor 10 is rotated and the exposure optical system 12Y is not operated, the transparent film 43 is wound up by the winding roller 42 in timed relationship with the rotation speed of the belt photoreceptor 10, for example, once per 100 copying operations. When the transparent film 43 is wound up, the transparent film 43 sliding-contacts with the image exposure surface of the transparent member 303Y, and the image exposure surface of the transparent member 303Y is cleaned.

The transparent member 303Y, the master roller 41 and the winding roller 42 between which the transparent film 43 is stretched, are held by the holding member 20 which holds the exposure optical systems 12Y, or the supporting member 50.

Figure 11:
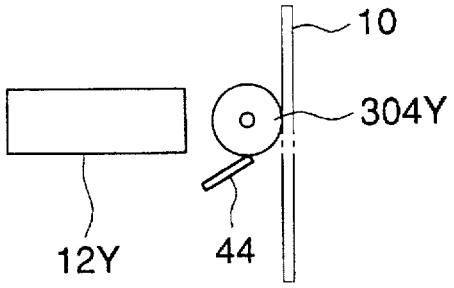
FIGS. 11(A) and 11(B) are views showing another example to remove stain on the transparent member.
Figure 11:
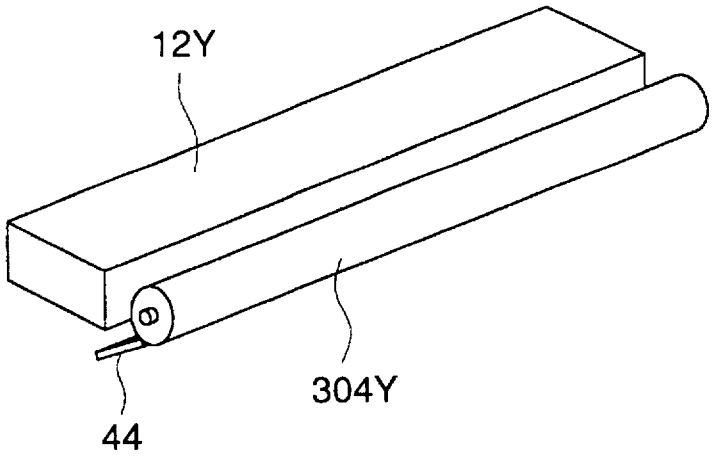

FIGS. 11(A) and 11(B) show another example to remove the stain on the transparent member. In FIGS. 11(A), and 11*b* a transparent member 304Y of a round bar which contacts with the belt photoreceptor 10 and is rotated, is used as a transparent member, and a cleaning blade 44 which is a stain prevention member, and which contacts with the transparent member 304Y and cleans toner or dusts on the transparent member, is used as a cleaning means.

Figure 12:
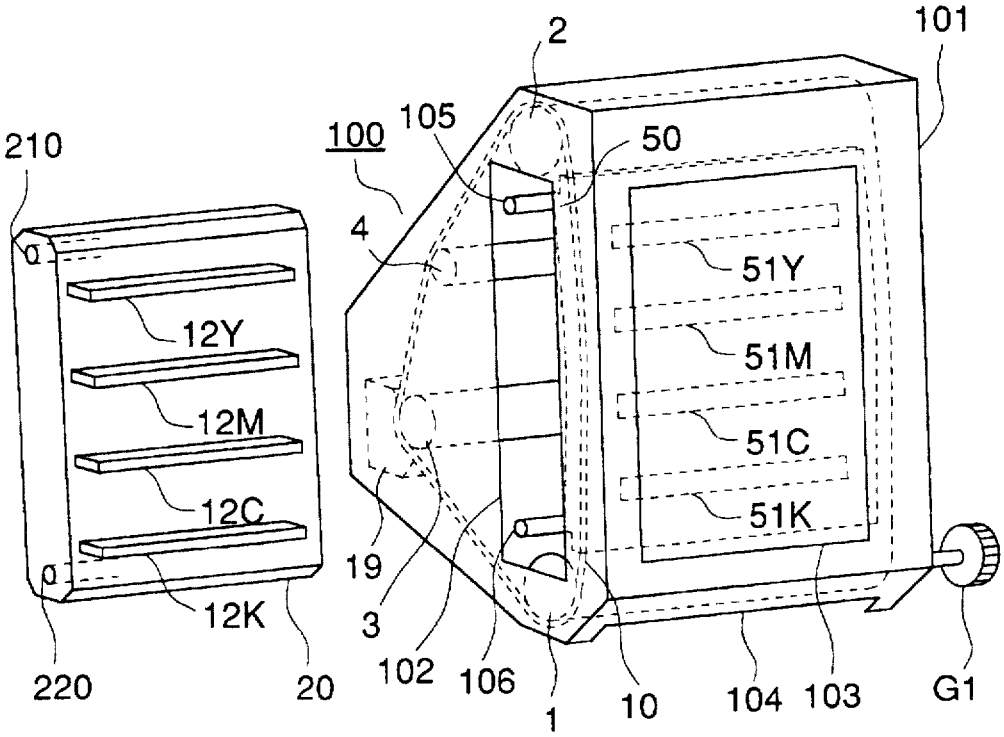
FIG. 12 is a view showing an example of a belt photoreceptor unit.
Figure 13:
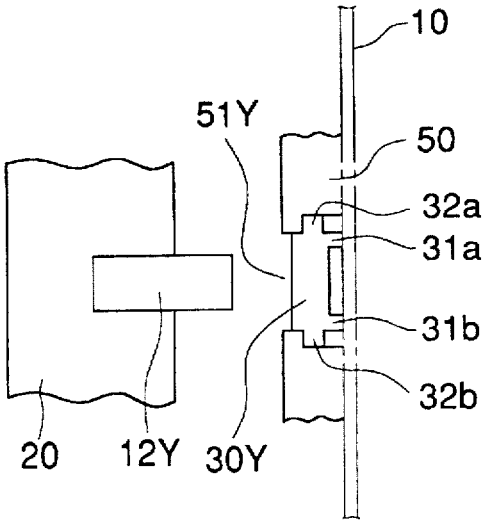
FIG. 13 is a view showing how to attach the transparent member shown in FIG. 12.

Referring to FIGS. 12 and 13, an example of arrangement of the transparent member in the above example, will be described using the belt photoreceptor unit. FIG. 12 is a view showing an example of the belt photoreceptor unit, and FIG. 13 is a view showing a method to attach the transparent member in FIG. 12.

The belt photoreceptor unit 100 shown by a dotted line in FIG. 1 is taken out upward after the upper cover, not shown in the drawing, is opened, after developing devices 13Y, 13M, 13*c*, 13*k*, and scorotron chargers 11Y, 11M, 11C and 11k are respectively retreated in the right direction in FIG. 1. In this case, a connecting portion, not shown in the drawing, to the waste toner tank 22 provided to the toner conveyance pipe 19*d* is separated.

A frame 101 is provided around the belt photoreceptor unit 100, and a drive roller 1, driven rollers 2, 3 and a tension roller 4 are fixed to the frame 101. The belt photoreceptor 10 are wound around each roller. A cleaning unit 19 is provided outside the belt photoreceptor 10, and a supporting member 50 for supporting the belt photoreceptor 10 is provided inside the belt photoreceptor 10, and they are respectively fixed inside the frame 101. Further, exposure optical systems 12Y, 12M, 12C and 12K fixed on the holding member 20 under the condition that they are included in the belt photoreceptor 10, are attached facing exposure openings 51Y, 51M, 51C and 51K provided on the supporting member 50. A gear G1, rotated by a drive motor, not shown in the drawing, which is provided in the image forming apparatus main body and connected to the drive roller 1, is provided outside the frame 101.

A combination hole 103 for developing devices 13Y, 13M, 13*c* and 13*k*, scorotron chargers 11Y, 11M, 11C and 11K, a clearance hole 104 for operations of the transfer roller 14*a*, and a mounting/dismounting hole 102 for the holding member 20 on which the exposure optical systems 12Y, 12M, 12C and 12K are fixed, are provided in the frame body 101. When the holding member 20 is installed into the frame body 101, the holding member is fixed by an engagement member, not shown in the drawing.

When the holding member 20 onto which the exposure optical systems 12Y, 12M, 12C and 12K are fixed, is mounted into or dismounted from the hole 102 of the frame 101, holes 210 and 220 provided in the holding member 20 are respectively engaged with or disengaged from supports 105 and 106 provided in the frame body 101, and the exposure optical systems 12Y, 12M, 12C and 12*k*, and the belt photoreceptor 10 are positioned with each other.

The transparent member 30Y is inserted into a slot 51Y provided in the supporting member 50 of the belt photoreceptor 10, and is engaged with engagement portions 32*a* and 32*b* provided on the side portions of the transparent member 30Y. Protrusions 31*a* and 31*b* are provided on the supporting member 50 under the condition that the protrusions are respectively in contact with the belt photoreceptor 10. Engagement portions 32*a* and 32*b* may be fixed on the supporting member 50, for example, by adhesives, screws, or the like. The transparent members 30M, 30C and 30K are attached in the same way as described above. Holes 210 and 220 provided in the holding member 20 are respectively engaged with and attached onto supports 105 and 106 provided in the frame body 101, and the exposure optical systems 12Y, 12M, 12C, 12K and the belt photoreceptor 10 are positioned while the transparent members 30Y, 30M, 30C and 30*k* are being sandwiched between them.

Figure 14:
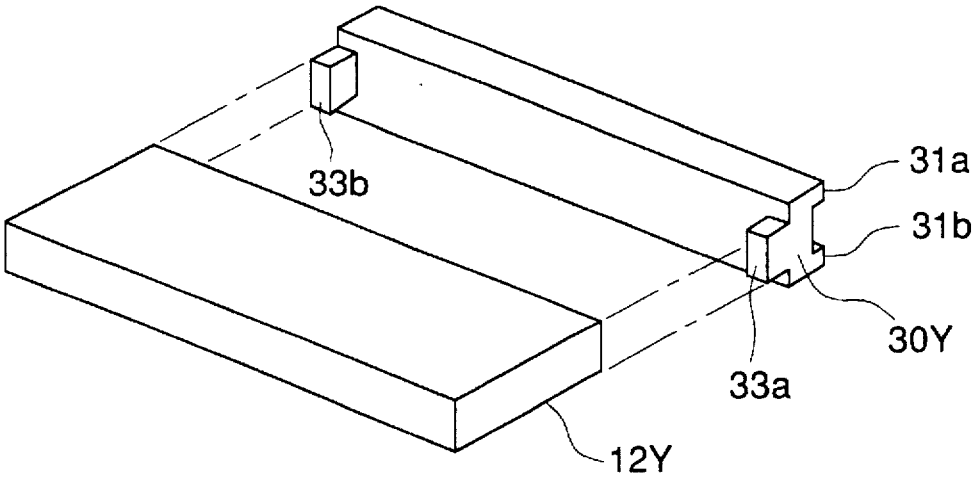
FIGS. 14(A) and 14(B) are views showing an example to combine the transparent member, exposure optical systems and a holding member.
Figure 14:
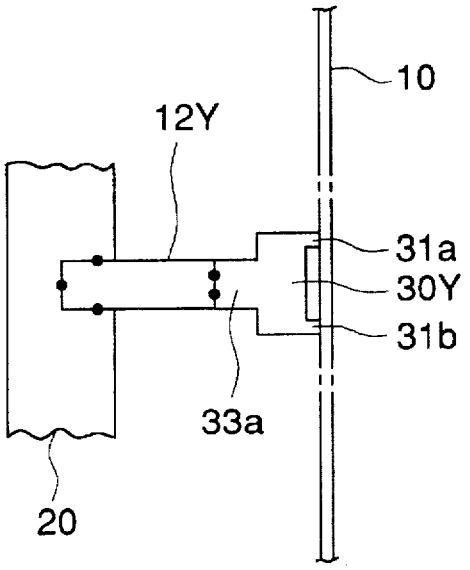
Figure 15:
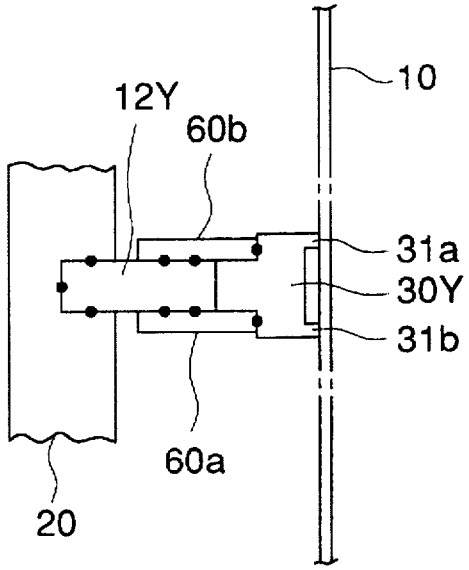
FIGS. 15(A) and 15(B) are views showing another example to combine the transparent member, exposure optical systems and the holding member.
Figure 15:
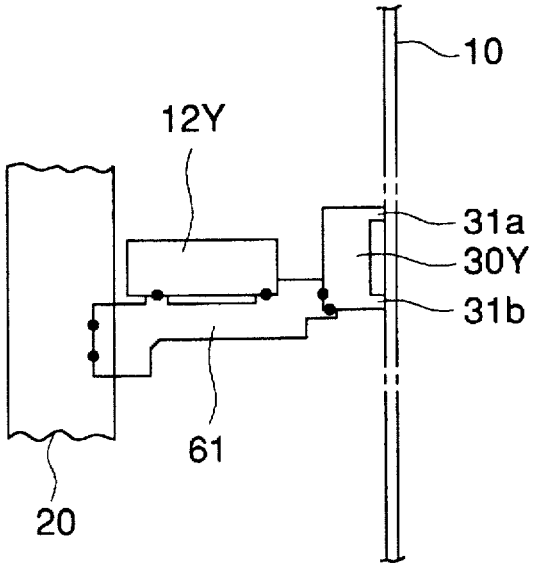
Figure 16:
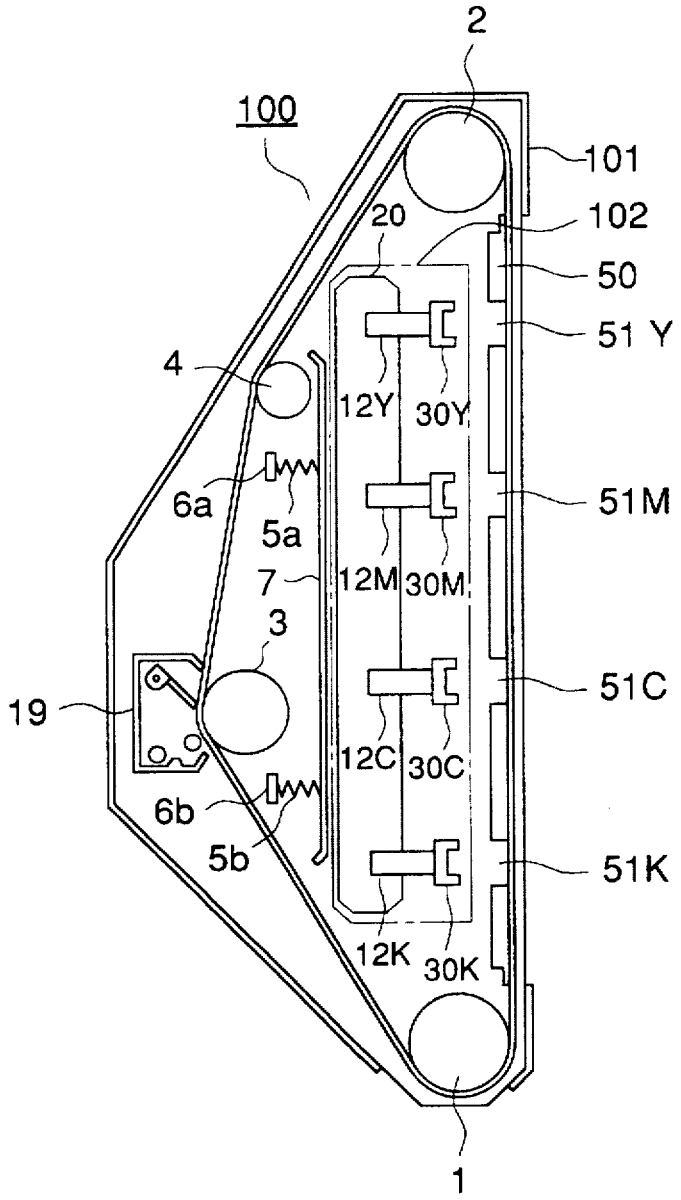
FIG. 16 is a view showing an example in which the holding member, onto which a plurality of exposure optical systems and transparent member are attached, is applied to the belt photoreceptor, using a belt photoreceptor unit.
Figure 17:
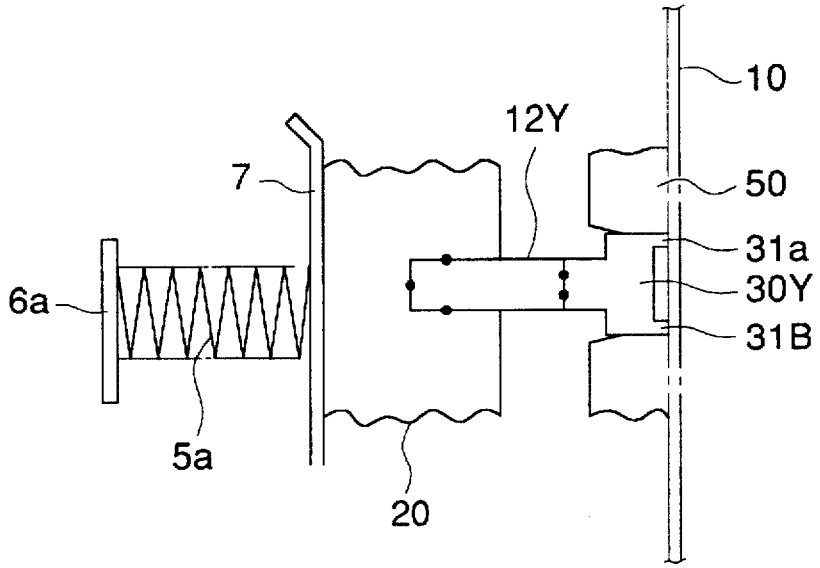
FIG. 17 is a view showing a method to press the transparent member to the belt photoreceptor.

An example of the structure for positioning the belt photoreceptor and the exposure optical systems, which is the third object of the present invention, will be described below using FIGS. 14 to 17. FIGS. 14(A) and 14(B) show an example of a method of combination of the transparent member, exposure optical systems and the holding member. FIGS. 15(A) and 15(B) are another example of a method of combination. FIG. 16 is a view showing an example in which the holding member provided with a plurality of exposure optical systems and the transparent member is applied to the belt photoreceptor, together with a view of the belt photoreceptor unit. FIG. 17 is a view showing a method for pressing the transparent member to the belt photoreceptor. The same numbers are denoted for corresponding members having the same function and structure as the belt photoreceptor unit shown in FIG. 12.

As shown in FIG. 14(A), attachment portions 33*a* and 33*b* are provided at both ends outside the image exposure scanning area of the transparent member 30Y facing an image exposure light emergence side of the exposure optical system 12Y. As shown in FIG. 14(B), the attachment portions 33*a* and 33*b* are fixed to the exposure optical system 12Y at positions, for example, indicated by black spots, using adhesives after attachment portions have been correctly positioned. A member, in which the transparent member 30Y is integrated with the exposure optical system 12Y, is fixed onto the holding member 20 of the exposure optical system at the black-spotted positions by adhesives, and is integrated with the holding member 20. The transparent member 30Y may be attached onto a member in which the exposure optical system 12Y is attached onto the holding member 20.

As shown in FIG. 15(A), the transparent member 30Y and the exposure optical system 12Y are fixed, for example, onto black-spotted portions using combination members 60*a* and 60*b* by adhesives. A member in which the transparent member 30Y is integrated with the exposure optical system 12Y, is fixed onto the holding member 20 of the exposure optical systems at black-spotted portions by adhesives, and may be integrated with the holding member 20. Further, as shown in FIG. 15(B), the transparent member 30Y and the exposure optical system 12Y may be adhered onto a combination member 61, for example, at the black-spotted portions by adhesives. A member in which the transparent member 30Y is integrated with the exposure optical system 12Y, may be adhered onto the holding member 20 of the exposure optical systems at the black-spotted portions by adhesives, and may be integrated with the holding member 20.

In the same manner, the exposure optical systems 12M, 12C and 12K, and the transparent members 30M, 30C and 30K are adhered onto the holding member 20.

As shown in FIG. 16, the holding member 20 onto which paired exposure optical systems 12Y, 12M, 12C, 12K and the transparent members 30Y, 30M, 30C and 30K are adhered, is included inside the belt photoreceptor 10 which is provided inside the frame body 101, through the mounting/dismounting hole 102, provided in the frame body 101, for the holding member 20. The holding member 20 is mounted in the belt photoreceptor unit 100 under the condition that the transparent members 30Y, 30M, 30C and 30K respectively face holes 51Y, 51M, 51C and 51K provided in the supporting member 50 for the belt photoreceptor 10.

As shown in FIGS. 16 and 17, a pressure plate 7 (pressing means) pressed by springs 5*a* and 5*b* attached to spring fixing plates 6*a* and 6*b* which are fixed in the frame base body 101, presses the holding member 20 by an operation of a pressure-contact release mechanism, not shown in the drawing, and protrusions 31*a* and 31*b* respectively provided on transparent members 30Y, 30M, 30C and 30K, come into pressure-contact with the inner surface of the belt photoreceptor 10. Accordingly, gaps between the belt photoreceptor and exposure optical systems 12Y, 12M, 12C and 12K are always maintained constant, and lifting of the belt photoreceptor 10 is prevented.

Also in the present example, it is preferable that, in order to maintain desirable sliding property with the belt photoreceptor 10, or to prevent toner adherence to projections 31*a* and 31*b*, film coating of fluororesin, teflon resin, or coating by burning, for example, by which excellent sliding characteristics can be achieved and toner adherence can be extremely few, is applied to the sliding portions of projections 31*a* and 31*b*, which are in sliding-contact with the belt photoreceptor 10, as a toner adherence prevention member, in the same manner as described in FIG. 8(A).

Further, in any of the above-described examples, it is preferable that the shape of the section of the supporting member 50 which is parallel to the movement direction of the photoreceptor 10, is convex, and the belt photoreceptor 10 is in contact with projections, so that the belt photoreceptor 10 is always in close contact with the supporting member 50.

According to the above-described examples, when the belt photoreceptor is rotated, the belt photoreceptor is in sliding-contact with the projections, thereby, the contact surface is reduced, the image exposed surface of the transparent member is not directly in slide-contact with the belt photoreceptor, and surface-like or spot-like toner staining is minimized, so that an excellent image with uniform exposure and no image streaking can be obtained.

Further, the transparent base body is not damaged, and the image exposure light permeability is not lowered due to stains on the transparent base body, so that an image forming apparatus in which an excellent image quality is maintained, can be provided.

Still further, gaps between the belt photoreceptor and the plurality of exposure optical systems are always maintained at a constant distance, and highly accurate positioning can be performed so that the positional relationship between these devices is maintained. Further, an image forming apparatus can be provided in which a lift of the belt photoreceptor can be prevented, image exposure registration and image forming positions do not vary, so that an excellent image is obtained. Yet further, a color image forming apparatus in which an excellent color image is obtained by superimposing toner images, can be provided.

Figure 18:
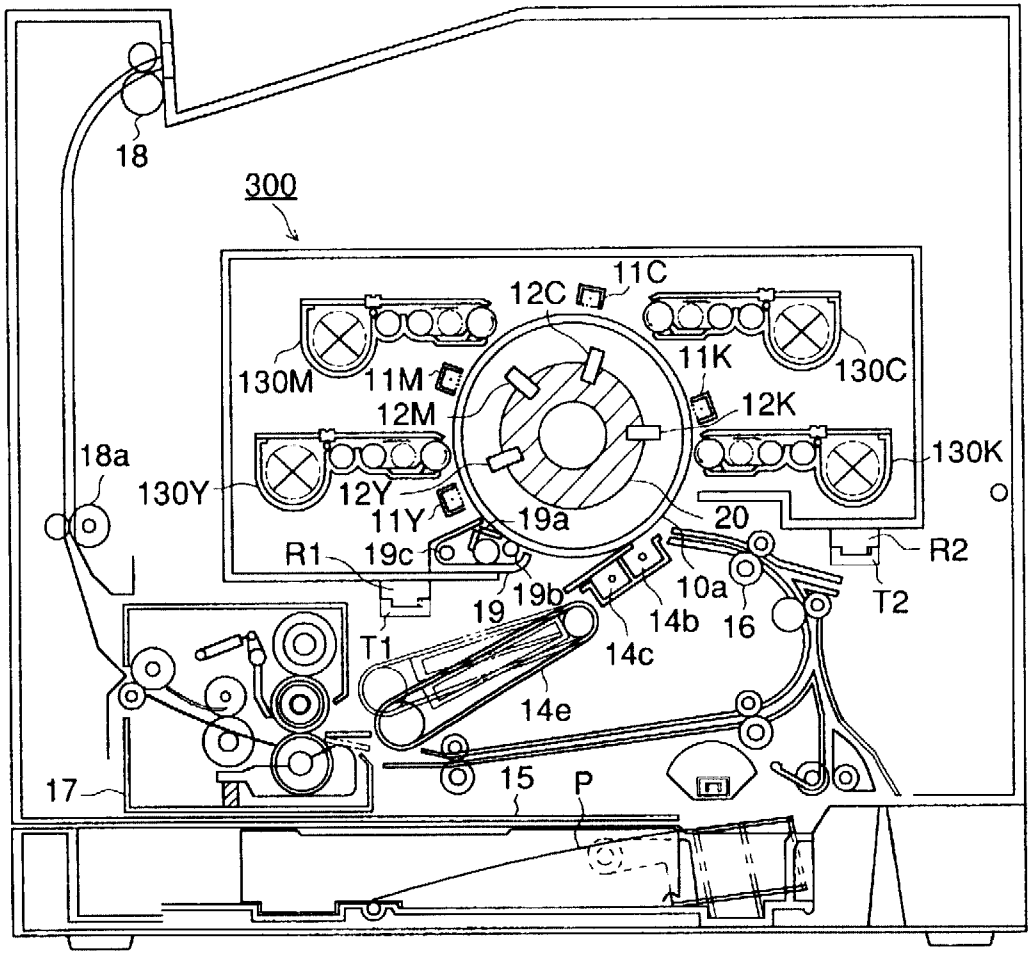
FIG. 18 is a sectional structural view showing another example of a color image forming apparatus of the present invention.
Figure 19:
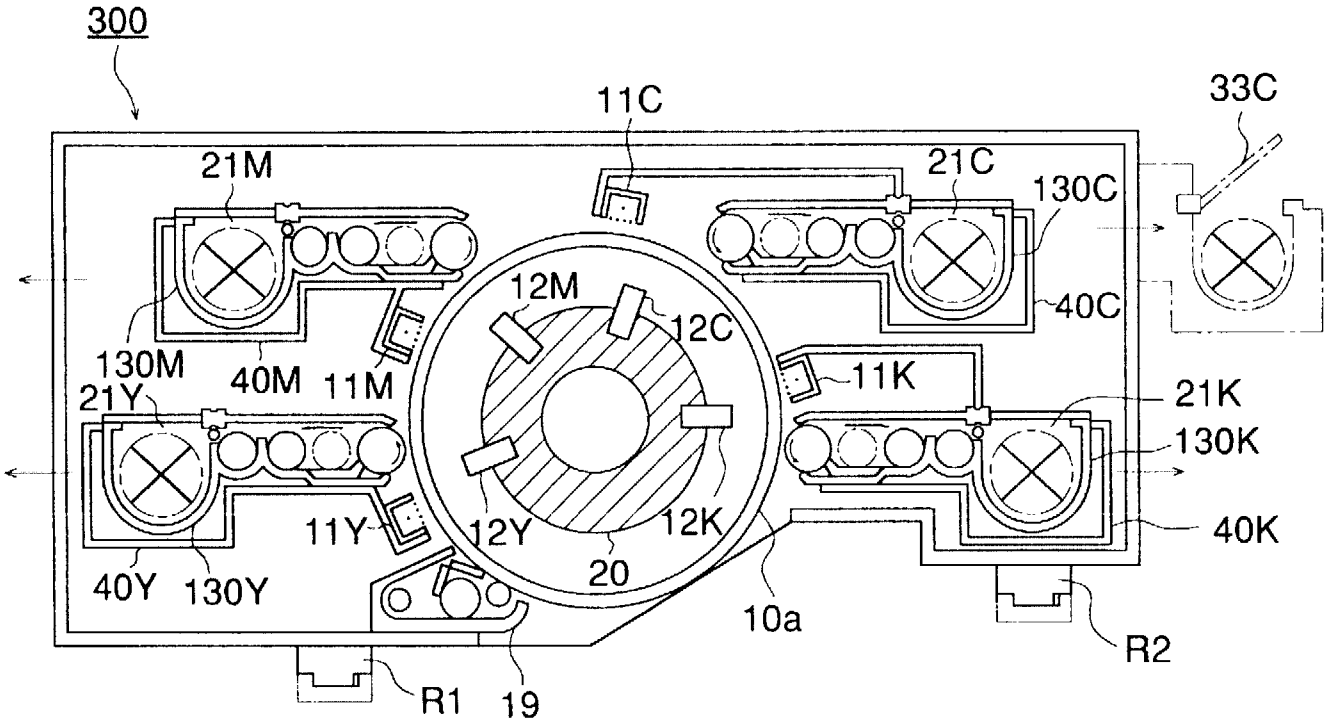
FIG. 19 is a view showing a process unit used in the color image forming apparatus shown in FIG. 18.

Another example of a color image forming apparatus to which the developing unit of the present invention is applied, will be described below using FIGS. 18 to 20(B). FIG. 18 is a sectional structural view showing another example of the color image forming apparatus, and FIG. 19 is a view showing a process unit for use in the color image forming apparatus shown in FIG. 19. FIGS. 20(A) and 20(B) are views showing developing devices used for the color image forming apparatus shown in FIG. 18.

In the color image forming apparatus of this example, an image is formed in the same image forming processes as those of the above-described examples explained using FIG. 1. A cylindrical photoreceptor drum is used as the image forming body, and a unit in which the replenishment tank is combined to the side portion of the developing device used in the above-described examples, is used as the developing unit. A holding member on which a plurality of exposure optical systems are provided, is arranged inside the photoreceptor drum. A process unit in which a plurality of developing units, in which developing devices and scorotron chargers are integrated for each color, are arranged outside the photoreceptor drum, is used for image formation. The same numerical codes are denoted for members having the same functions and structures as those shown in FIG. 1.

A photoreceptor drum 10*a*, which is an image forming body, is composed of a cylindrical base body, the inside of which is formed of a transparent member such as optical glass or transparent acrylic resins, for example, and a photoreceptor layer such as a transparent electrical conductive layer, an aSi layer or an organic photoreceptor layer (OPC), is formed on the drum. The photoreceptor drum 10*a* is rotated clockwise under the electrically grounded condition. The color image forming process is conducted using the same members and means as those in the above-described examples.

In this example, the transparent base body may have only an amount of exposure, the wavelength of which can form an appropriate contrast with light attenuation characteristics of a light conductive layer (light carrier generation), in a light conductive layer of the photoreceptor drum 10*a* which is an image forming point of exposure beams for image exposure. Accordingly, it is not necessary that a light transparency factor of a transparent base body of the photoreceptor drum 10*a* be 100%, but it may have a characteristic in which some amount of light is absorbed at the time of transmission of the exposure beam. As transparent base body materials, soda glass, Pyrex glass, boric silicate glass, or any type of light transmissive resins such as acryl, fluorine, polyester, polycarbonate, polyethylene terephtalate, etc., can be used. As a light transmission conductive layer, indium, tin oxide (ITO), lead oxide, indium oxide, copper iodide, or a metallic film, in which light permeability is maintained, and which is formed of Au, Ag, Ni, Al, etc., can be used. As film forming methods, a vacuum deposition method, an activated reaction deposition method, any type of spattering method, any type of CVD method, a dip coating method, a spray coating method, etc., can be used. As light conductive layers, an amorphous silicon (a-Si) alloy photoreceptor layer, an amorphous selenium alloy photoreceptor layer, or any type of organic photoreceptor layer (OPC), can be used.

A color toner image thus formed on the peripheral surface of the photoreceptor drum 10*a*, is transferred onto a transfer sheet P, which is a transfer material, in a transfer electrode 14*b* as a transfer unit, wherein the transfer sheet P is fed by a sheet feed cassette 15, conveyed to a timing roller 16, and is fed in timed relationship with the toner image on the photoreceptor drum 10*a* by the timing roller 16.

After the transfer sheet P on which the toner image was transferred, has been separated from the peripheral surface of the photoreceptor drum 10*a* by discharging in a discharger 14*c*, the transfer sheet P is conveyed to a fixing unit 17 by a conveyance belt 14*e*. In the fixing unit 17, the transfer sheet P is heated and pressure-contacted, and toner is fused and fixed on the transfer sheet P. After that, the transfer sheet P is delivered from the transfer unit 17, conveyed by delivery sheet conveyance rollers 18*a* and 18*b*, and delivered onto a tray in the upper portion of the apparatus by a sheet delivery roller 18.

The surface of the photoreceptor drum 10*a* from which the transfer sheet has been separated, is slidably contacted with a cleaning blade 19*a* and a cleaning roller 19*b* in a cleaning unit 19, and the residual toner is removed and the surface of the photoreceptor drum 10*a* is cleaned. The toner image of the document image is continuously formed on the photoreceptor drum, or the photoreceptor drum temporarily stops for toner image formation of a new document image. After cleaning, the cleaning blade 19*a* and the cleaning roller 19*b* are maintained under the condition that these are separated from the photoreceptor drum 10*a* in order to prevent the photoreceptor drum 10*a* from being damaged.

Developing devices 130Y, 130M, 130C and 130K are formed by connecting replenishment tanks 21Y, 21M, 21C and 21K to the side surfaces of developing devices 13Y, 13M, 13C and 13K, described in the above-described example. The holding member 20 onto which exposure optical systems 12Y, 12M, 12C and 12K are fixed, is arranged inside the photoreceptor drum 10*a*. Developing units 40Y, 40M, 40C and 40K in which scorotron chargers 11Y, 11M, 11C, 11K and developing devices 130Y, 130M, 130C, 130K are respectively integrated for each color, and the cleaning unit 19 are arranged outside the photoreceptor drum 10*a*, and thus a process unit 300 is, structured. The process unit 300 is detachably provided in the apparatus main body using guide rails T1, T2 provided on the apparatus main body and corresponding guide members R1 and R2 provided on the process unit 300.

The process unit 300 is pulled out from the apparatus main body, and maintenance or replacement of the photoreceptor drum or exposure optical systems is carried out. When maintenance operations such as cleaning or replacement of scorotron chargers, maintenance or replacement of developing devices, or replenishment of developer to replenishment tanks, are carried out, developing units 40Y, 40M, 40C and 40K integrated with chargers are horizontally detached after doors, not shown in the drawing, provided on the side portion of the process unit 300, have been opened under the condition that the process unit 300 has been pulled out from the apparatus main body. Replenishment of developer is carried out after an upper covers 33Y, 33M, 33C and 33K of replenishment tanks have been opened.

As shown in FIGS. 20(A) and 20(B), developer replenished into the replenishment tank 21K is drawn up by rotation of developer drawing-up vanes 132K and 133K, and dropped into a stirring section 134K by a replenishment roller 138K. Developer stirred by 2 stirring rollers 136K and 137K is conveyed to a developing sleeve 131K by a supply roller 135K, and a latent image on the photoreceptor drum 10*a* is developed.

What is claimed is:

1. An image forming apparatus for forming a multi-color image, comprising:

a rotatable image forming member which is enclosed on itself to form an inner surface and an outer surface;

a plurality of exposure devices each provided inside the image forming member for conducting an exposure operation toward the inner surface of the image forming member; and a plurality of independently detachable units each including a charger for electrically charging the outer surface of the image forming member and a developing device having one of a plurality of color toners for developing a latent image, each of the plurality of units being disposed near the outer surface of the image forming member so as to be opposite to a respective one of the plurality of exposure devices provided inside the image forming member so that a multi-color toner image may be formed on the outer surface of the image forming member during a single rotation of the image forming member, wherein each of the plurality of exposure devices comprises a plurality of light emitting elements aligned along a width of the image forming member to face the inner surface of the image forming member, and a transparent member provided between the plurality of exposing elements and the inner surface of the image forming member, and wherein the transparent member has a length corresponding to the width of the image forming member and comprises protrusions corresponding to positions along the width of the image forming member on which light is not emitted by one of the plurality of light emitting elements.

2. The apparatus of claim 1, wherein each of the protrusions of the transparent member comprises a coated layer for preventing toner adhesion.

3. The apparatus of claim 1, further comprising a supporting member on which the plurality of exposure devices are provided, and a pushing member for pushing the supporting member toward the image forming member.

4. The apparatus of claim 3, wherein the supporting member and the transparent member comprise a single body so that when the pushing member pushes the supporting member toward the image forming member, the protrusions of the transparent member are contacted with the image forming member at the positions along the width of the image forming member on which light is not emitted by one of the plurality of light emitting elements.

5. An image forming apparatus for forming a multi-color image, comprising:

a rotatable belt-shaped image forming member which is enclosed on itself to form an inner surface and an outer surface;

a plurality of exposure devices each provided inside the belt-shaped image forming member for conducting an exposure operation toward the inner surface of the belt-shaped image forming member; and a plurality of independently detachable units, each unit including a charger for electrically charging the outer surface of the image forming member and a developing device having one of a plurality of color toners for developing a latent image, each of the plurality of units being disposed near the outer surface of the image forming member so as to be opposite to a respective one of the plurality of exposure devices provided inside the image forming member so that a multi-color toner image may be formed on the outer surface of the image forming member during a single rotation of the image forming member, wherein each of the plurality of exposure devices comprises a plurality of light emitting elements aligned along a width of the image forming member to face the inner surface of the image forming member, and a transparent member provided between the plurality of exposing elements and the inner surface of the image forming member so that the transparent member prevents the plurality of light emitting elements from becoming dirty, wherein the transparent member is arranged to come in contact with the inner surface of the image forming member so that the transparent member guides the rotation of the image forming member, and wherein each of the plurality of exposing devices further comprises a cleaning member for cleaning the transparent member.

6. An image forming apparatus for forming a multi-color image, comprising:

a rotatable image forming member which is enclosed on itself to form an inner surface and an outer surface, wherein the image forming member comprises a transparent base member and a photoconductive layer, and wherein the inner surface is formed by the transparent base member and the outer surface is formed by the photoconductive layer;

a plurality of exposure devices each provided inside the image forming member for conducting an exposure operation toward the inner surface of the image forming member so that the photoconductive layer is exposed through the transparent base member; and a plurality of independently detachable units, each unit comprising a charger for electrically charging the outer surface of the image forming member, a developing device having one of a plurality of color toners for developing a latent image, and a housing enclosing the charger and the developing device so that each set of the enclosed charger and developing device is isolated by the housing from other sets of a charger and a developing device, wherein each of the plurality of units is disposed near the outer surface of the image forming member, wherein the charger and developing device of each of the plurality of units are spaced apart within their respective housings and are positioned to face respective portions of the outer surface of the image forming member so that respective charging sections and developing sections are formed, wherein each of the plurality of exposure devices is arranged to be opposite to a respective one of the plurality of units so that respective exposure sections are formed between the respective charging sections and developing sections, and wherein the image forming member is rotatable such that (i) respective portions of the image forming member are charged at the respective charging sections, (ii) the respective charged portions of the image forming member are exposed at the respective exposure sections to form respective portions of a latent image, and (iii) the respective portions of the latent image are developed at the respective developing sections to form a color toner image, whereby a multi-color toner image may be formed on the outer surface of the image forming member during a single rotation of the image forming member.

7. The apparatus of claim 6, wherein the plurality of units are interchangeable with each other.

8. The apparatus of claim 6, wherein each of the plurality of units comprises a developer replenishing tank.

9. The apparatus of claim 6, wherein the image forming member and the plurality of exposure devices comprise a single unit that is detachable from the image forming apparatus.

10. The apparatus of claim 6, wherein the image forming member comprises a drum-shaped photoreceptor.

11. The apparatus of claim 6, wherein the image forming member comprises an endless belt-shaped photoreceptor.

12. The apparatus of claim 11, further comprising an upper roller and a lower roller around which the belt-shaped photoreceptor is vertically stretched.

13. The apparatus of claim 12, wherein the plurality of units are provided vertically along a first side of the vertically stretched belt-shaped photoreceptor.

14. The apparatus of claim 12, further comprising a transfer section for transferring the multi-color toner image onto a sheet, wherein the transfer section is provided beneath the lower roller.

15. The apparatus of claim 12, further comprising a transfer section for transferring the multi-color toner image onto a sheet, wherein the transfer section is provided on the upper roller.

16. The apparatus of claim 13, further comprising a housing for holding the belt-shaped photoreceptor, the plurality of image exposure devices and the plurality of units, wherein the housing includes a plurality of access doors respectively corresponding to the plurality of units so that each of the plurality of units may be independently removed from the housing through its respective corresponding access door.

17. The apparatus of claim 13, further comprising a sheet delivery section for delivering a sheet into the image forming apparatus, wherein the sheet delivery section is provided on a second side of the vertically stretched belt-shaped photoreceptor opposite to the first side.

* * * * *